US006832949B2

(12) United States Patent
Konno et al.

(10) Patent No.: US 6,832,949 B2
(45) Date of Patent: Dec. 21, 2004

(54) WINDOW MEMBER FOR CHEMICAL MECHANICAL POLISHING AND POLISHING PAD

(75) Inventors: Tomohisa Konno, Mie (JP); Masayuki Motonari, Mie (JP); Masayuki Hattori, Mie (JP); Kou Hasegawa, Mie (JP); Nobuo Kawahashi, Mie (JP)

(73) Assignee: JSR Corporation, Tokyo (JP)

( * ) Notice: Subject to any disclaimer, the term of this patent is extended or adjusted under 35 U.S.C. 154(b) by 2 days.

(21) Appl. No.: 10/279,843

(22) Filed: Oct. 25, 2002

(65) Prior Publication Data

US 2003/0129931 A1 Jul. 10, 2003

(30) Foreign Application Priority Data

Oct. 26, 2001 (JP) ..... 2001-329662

(51) Int. Cl.[7] ..... B24B 5/00
(52) U.S. Cl. ..... 451/285; 451/6; 451/288
(58) Field of Search ..... 451/285–289, 451/5, 41, 6

(56) References Cited

U.S. PATENT DOCUMENTS

| | | | | |
|---|---|---|---|---|
| 5,909,314 A | * | 6/1999 | Oka et al. | 359/582 |
| 6,228,480 B1 | * | 5/2001 | Kimura et al. | 428/328 |
| 6,302,767 B1 | | 10/2001 | Tietz | |
| 6,337,129 B1 | * | 1/2002 | Watanabe et al. | 428/328 |
| 6,444,898 B1 | * | 9/2002 | Fujisawa et al. | 136/256 |
| 6,621,584 B2 | * | 9/2003 | Pecen et al. | 356/630 |

FOREIGN PATENT DOCUMENTS

| | | | | |
|---|---|---|---|---|
| EP | 0 629 673 | | 12/1994 | |
| EP | 0 844 265 | | 5/1998 | |
| EP | 0 941 806 | | 9/1999 | |
| JP | 9-007985 | | 1/1997 | |
| JP | 11-512977 | | 11/1999 | |
| JP | 2000-326220 | | 11/2000 | |
| JP | 001306163 | A1 * | 2/2003 | 451/285 |
| WO | WO 97/06921 | | 2/1997 | |

* cited by examiner

*Primary Examiner*—Lee D. Wilson
(74) *Attorney, Agent, or Firm*—Oblon, Spivak, McClelland, Maier & Neustadt, P.C.

(57) ABSTRACT

An object of the present invention is to provide a window member for chemical mechanical polishing, which is excellent in antifouling property and transparency and is excellent in anti-scratching and, further, can easily perform detection of a polishing endpoint of the surface of a semiconductor wafer by passing a light for endpoint detection, in polishing of a semiconductor wafer using an optical endpoint detecting apparatus and also to a polishing pad. A window member for chemical mechanical polishing of the present invention is provided with a substrate part (comprised of polyurethane resin and the like), which is transparent partly at least, an antifouling resin layer formed on at least one side of the substrate part. This antifouling resin layer is preferably comprised of a fluorine-based polymer having a polysiloxane segment in a main chain. A polishing pad may be the one that a window member is fitted in a through hole of a substrate for a polishing pad (comprised of polyurethane resin and the like, disc-like, belt-like or the like) provided with a through hole penetrating from surface to back, or adhered to a substrate for a polishing pad so as to cover an opening part of the through hole.

24 Claims, 14 Drawing Sheets

WINDOW MEMBER FOR CHEMICAL MECHANICAL POLISHING AND POLISHING PAD

BACKGROUND OF THE INVENTION

1. Field of the Invention

The present invention relates to a window member for chemical mechanical polishing and a polishing pad. More particularly the present invention relates to a window member for chemical mechanical polishing excellent in antifouling property and transparency, and a polishing pad using the same, and also to a window member for chemical mechanical polishing excellent also in anti-scratching and a polishing pad using the same.

2. Description of the Prior Art

When a semiconductor wafer is polished using a slurry by chemical mechanical polishing, a polishing pad is fixed on a surface plate of a polishing apparatus and, on the other hand, a semiconductor wafer is fixed on a lower end of a pressure head and this semiconductor wafer is abutted against the polishing pad while pressing under a prescribed pressure. And, it is known that polishing is performed by sliding a semiconductor wafer and a polishing pad by rotating the surface plate and the pressure head while a slurry is added dropwise on the surface plate at a prescribed amount from a slurry supplying part. As this polishing pad, a resin such as polyurethane is usually used.

However, in this conventional polishing pad, there were problems that the surface of the polishing pad is deteriorated, damaged or colored by repeating polishing and, thus, durability and antifouling property are not sufficient.

In addition, recently, an optical endpoint detecting apparatus and a detecting method that are using an optical method by which the state of a polished surface can be directly observed disclosed in, for example, JP-A-9-7985 and JP-A-2000-3262 are known.

In these optical endpoint detecting apparatus and methods, generally, a window member through which a light for detecting an endpoint can transmit as disclosed in, for example, JP-A-11-512977, and which is comprised of a hard and uniform resin, is formed in a polishing pad, and a surface to be polished is observed through this window member.

As a material constituting this window member, usually, various resins are used. However, there are problems that the surface of the window member is damaged or colored by repeating chemical mechanical polishing and, thus, endpoint detection is interfered.

SUMMARY OF THE INVENTION

The present invention solves the above-mentioned problems and an object of the present invention is to provide a window member for chemical mechanical polishing excellent in antifouling property and transparency, and is excellent also in anti-scratching and a polishing pad using the same. Further, another object of the present invention is to provide a window member for chemical mechanical polishing leads to an easy detection a polishing endpoint of the semiconductor wafer surface by transmitting a light for endpoint detection, for polishing of a semiconductor wafer using an optical endpoint detecting apparatus.

The present invention is based on the findings described above and can be described as follows.

1. A window member for chemical mechanical polishing comprising a substrate part which is transparent partially or all, and an antifouling resin layer formed on at least one side of the substrate part.

2. The window member for chemical mechanical polishing according to 1 above, wherein the antifouling resin layer is comprised of a fluorine-based polymer having a polysiloxane segment in a main chain.

3. The window member for chemical mechanical polishing according to 2 above, wherein the substrate part is comprised of at least one resin selected from the group consisting of a polyester resin, a triacetylcellulose resin, a polycarbonate resin, an allylcarbonate resin, a polyethersulfone resin, a polyacrylate resin, a norbornene resin, an acrylstyrene resin, a polyurethane resin and a polyolefin resin.

4. The window member for chemical mechanical polishing according to 1 above, wherein the antifouling resin layer is cured a curable resin composition comprising an olefin-based polymer having a polysiloxane segment in a main chain, whose content of fluorine is 20 wt % or more, and whose molecular weight is 5,000 or more reduced to polystyrene, and a crosslinkable compound.

5. The window member for chemical mechanical polishing according to 4 above, wherein the olefin-based polymer has a hydroxyl group and/or an epoxy group.

6. The window member for chemical mechanical polishing according to 5 above, wherein the substrate part is comprised of at least one resin selected from the group consisting of a polyester resin, a triacetylcellulose resin, a polycarbonate resin, an allylcarbonate resin, a polyethersulfone resin, a polyacrylate resin, a norbornene resin, an acrylstyrene resin, a polyurethane resin and a polyolefin resin.

7. A polishing pad having a window member for chemical mechanical polishing comprising a substrate part which is transparent partially or all, and an antifouling resin layer formed on at least one side of the substrate part.

8. The polishing pad according to 7 above, wherein the antifouling resin layer is comprised of a fluorine-based polymer having a polysiloxane segment in a main chain.

9. The polishing pad according to 8 above, wherein the substrate part is comprised of at least one resin selected from the group consisting of a polyester resin, a triacetylcellulose resin, a polycarbonate resin, an allylcarbonate resin, a polyethersulfone resin, a polyacrylate resin, a norbornene resin, an acrylstyrene resin, a polyurethane resin and a polyolefin resin.

10. The polishing pad according to 9 above, wherein the window member for chemical mechanical polishing is fixed to a through hole of a substrate for a polishing pad provided with the through hole penetrating from surface to back, or is adhered to the substrate for a polishing pad so as to cover an opening part of the through hole.

11. The polishing pad according to 10 above, further comprising a supporting layer laminated on a back of the substrate for a polishing pad.

12. The polishing pad according to 9 above, wherein the window member for chemical mechanical polishing is inserted between two or more divided substrates for a polishing pad.

13. The polishing pad according to 12 above, further comprising a supporting layer laminated on a back of the substrate for a polishing pad.

14. The polishing pad according to 7 above, wherein the antifouling resin layer is cured a curable resin composition comprising an olefin-based polymer having a polysiloxane segment in a main chain, whose content of fluorine is 20 wt % or more, and whose molecular weight is 5,000 or more reduced to polystyrene, and a crosslinkable compound.

15. The polishing pad according to 14 above, wherein the olefin-based polymer has a hydroxyl group and/or an epoxy group.

16. The polishing pad according to 15 above, wherein the substrate part is comprised of at least one resin selected from the group consisting of a polyester resin, a triacetylcellulose resin, a polycarbonate resin, an allylcarbonate resin, a polyethersulfone resin, a polyacrylate resin, a norbornene resin, an acrylstyrene resin, a polyurethane resin and a polyolefin resin.

17. The polishing pad according to 16 above, wherein the window member for chemical mechanical polishing is fixed to a through hole of a substrate for a polishing pad provided with the through hole penetrating from surface to back, or is adhered to the substrate for a polishing pad so as to cover an opening part of the through hole.

18. The polishing pad according to 17 above, further comprising a supporting layer laminated on a back of the substrate for a polishing pad.

19. The polishing pad according to 16 above, wherein the window member for chemical mechanical polishing is inserted between two or more divided substrates for a polishing pad.

20. The polishing pad according to 19 above, further comprising a supporting layer laminated on a back of the substrate for a polishing pad.

EFFECTS OF THE INVENTION

The window member for chemical mechanical polishing of the present invention is excellent in antifouling property and transparency, and is excellent also in anti-scratching. Therefore, with the window member for chemical mechanical polishing of the present invention excellent in antifouling property, a polishing pad to perform an optical endpoint detection stably can be provided.

When the polishing pad of the present invention is used, since the surface of the window member is not stained or slightly stained in use of a slurry for chemical mechanical polishing, optical endpoint detection can be stably performed. Since the present polishing pad is also excellent in anti-scratching, the optical endpoint detection can be further stably performed even by repetitive use.

DETAILED DESCRIPTION OF THE INVENTION

The present invention will be explained in detail.

1. Window Member for Chemical Mechanical Polishing

The window member for chemical mechanical polishing of the present invention (hereinafter, also referred to as simply "window member") is a member having light transmitting properties, which is used as a monitoring window in order to detect a polishing endpoint during chemical mechanical polishing of materials to be polished, and a window member 12 composed of a substrate part 12*a* which is transparent partially or all, and an antifouling resin layer 12*b* formed on at least one side thereof, for example, shown in FIG. 1. The antifouling resin layer 12*b* is usually formed on one side thereof, but the layer may be formed only on the surface of a transparent part of the side.

(Substrate Part)

The substrate is the one which is transparent to a light partly at least, and the word "transparent" is used in a broad sense including colored and transparent, and translucent. It is preferable that the transparency is higher. In addition, at least a part of this substrate part may be transparent, that is, a whole substrate part may be transparent, or a part of the substrate may be transparent. When a part of the substrate part is transparent, it is sufficient that the light for endpoint detection transmits through the part.

As a material constituting the "substrate part" (hereinafter, also referred to as "substrate part material"), a thermoplastic resin, a thermosetting resin, an elastomer and a rubber which give light transmitting properties can be used. Alternatively, a glass may be used. It is preferable that the substrate part has a flexibility from viewpoints of the polishing condition, the adherability to a substrate for a polishing pad, the workability in exchanging window members if necessary and the like. In particular, in the case of belt type polishing apparatus, it is particularly preferable that the substrate part has a flexibility. From a viewpoint of the flexibility, a thermoplastic resin, an elastomer and a rubber are preferable.

<Substrate Part Material>

Examples of the thermoplastic resin include a polyolefin-based resin, a polystyrene-based resin, an acrylic-based resin [including a (meth)acrylate-based resin], a vinyl ester resin (except for an acrylic resin), a polyester-based resin, a polyamide-based resin, a fluorine resin, a polycarbonate resin, a polyacetal resin and the like. And, examples of the thermosetting resin include a phenol resin, an epoxy resin, an unsaturated polyester resin, a polyurethane resin, a polyurethane-urea resin and a urea resin, a silicone resin and the like. Among them, from viewpoints of the light transmitting properties and the durability, a polyester resin, a triacetylcellulose resin, a polycarbonate resin, an allylcarbonate resin, a polyethersulfone resin, an acrylic resin, a norbornene resin, an acrylstyrene resin, a polyurethane resin and a polyolefin resin are preferable.

Further, examples of the elastomer include styrene-based elastomers such as a styrene-butadiene-styrene block copolymer (SBS) and a hydrogenated block copolymer thereof (SEBS), thermoplastic elastomers such as a polyolefin elastomer (TPO), a thermoplastic polyurethane elastomer(TPU), a thermoplastic polyester elastomer (TPEE), a polyamide elastomer (TPAE) and a diene-based elastomer (1,2-polybutadiene etc.), a silicone resin-based elastomer, a fluorine resin-based elastomer and the like.

In addition, examples of the rubber include a butadiene rubber, a styrene-butadiene rubber, an isoprene rubber, an isobutylene-isoprene rubber, an acrylic rubber, an acrylonitrile-butadiene rubber, an ethylene-propylene rubber, an ethylene-propylene-diene rubber, a silicone rubber, a fluorine rubber and the like.

The substrate part material may be modified with at least one kind of an acid anhydride group, a carboxyl group, a hydroxyl group, an epoxy group and an amino group. By modification, the affinity with an abrasive, an aqueous medium and the like constituting a slurry can be regulated. In addition, these substrate part materials may be used in combination of two or more.

The substrate part material may be a crosslinked polymer or a noncrosslinked polymer and it is not particularly limited. But it is preferable that at least a part thereof is a crosslinked polymer (including a case wherein a material made of a mixture of two or more components and at least a part of at least one of the components is a crosslinked polymer and a case wherein a material made of one component and at least a part of the component is a crosslinked polymer).

By having a crosslinked structure in at least a part of the substrate part material, the elastic recovery property is given to the substrate part. Therefore, a displacement by stress applied to a polishing pad during polishing can be suppressed, and excess stretching of a substrate part during polishing and dressing and burial of pores due to plastic deformation can be prevented. For this reason, the retaining of a slurry during polishing is better, and recovery of the retaining of the slurry by dressing is easy.

Consequently examples of the crosslinked polymer include, among the above-mentioned thermoplastic resin, thermosetting resin, elastomer and rubber which give light transmitting properties, polymers obtained by crosslinking resins such as a polyurethane resin, an epoxy resin, a polyacrylic resin, an unsaturated polyester resin and a vinyl ester resin (except for a polyacrylic resin), a diene-based elastomer such as 1,2-polybutadiene, rubbers such as a butadiene rubber, an isoprene rubber, an acrylic rubber, an acrylonitrile-butadiene rubber, a styrene-butadiene rubber, an ethylene-propylene rubber, a silicone rubber, a fluorine rubber and a styrene-isoprene rubber, and polymers obtained by crosslinking polyethylene, polyvinylidene fluoride and the like (by a crosslinkable agent, irradiation of ultraviolet-ray, electron beam or the like). Besides, an ionomer and the like may be used.

Among these polymers, a polyurethane resin and crosslinked 1,2-polybutadiene are particularly preferred, because they can give sufficient light transmitting properties, and are stable against a strong acid or a strong alkali contained in many slurries and, further, little softening due to water absorption. This crosslinked 1,2-polybutadiene may be used by blending other rubbers such as a butadiene rubber and an isoprene rubber.

(Shape of Substrate Part)

A shape of the substrate part is not particularly limited, but various shapes can be used according to an object and a utility. For example, a substrate part 12*a* may be massive-like (see FIG. 1, FIG. 3. FIG. 4, FIG. 10 etc.), plate-like, disc-like or sheet-like (see FIG. 8, Fi.12 etc.), belt-like (see FIG. 2, FIGS. 23–28), long film-like (string-like) or long sheet-like. In addition, a shape of a longitudinal cross section of the substrate may be rectangular (see FIG. 1 and FIG. 8), reverse T letter-like (see FIG. 4 etc.), T letter-like (see FIG. 6 etc.) and so on. This belt-like shape shown in FIG. 2 can be usually applied to a belt-like polishing pad as shown in FIG. 27. Further, a thickness of the substrate part itself can be made to be small by providing a concave part 13 thereon (see for example FIG. 11). Thereby, the light transmitting properties of this substrate part itself can be enhanced.

(Antifouling Resin Layer)

It is preferable that the antifouling resin layer is provided with a part having the transparency explained for the above-mentioned substrate part. Further, an antifouling resin layer is preferably such that at least a part of a window member comprised of the above-mentioned substrate part and the antifouling resin layer has light transmitting properties.

The antifouling resin layer may be made of any materials as long as they do not contaminate the surface of the layer due to attachment of a slurry component, a polishing wastage, or an abrasion dust of a polishing pad. In the present invention, the antifouling resin layer can be made of a fluorine-based resin polymer having a polysiloxane segment in a main chain.

<Fluorine-based Polymer>

The preferred fluorine-based polymer is an olefin-based polymer (hereinafter, also referred to as "specific fluorine-based polymer") which has a polysiloxane segment in a main chain, whose content of fluorine is 30 wt % or more, and whose number-average molecular weight is 5,000 or more reduced to polystyrene by GPC method. The specific fluorine-based polymer is an olefin-based polymer having a polysiloxane segment represented by the following general formula (1) in a main chain, and a ratio of the polysiloxane segment in the specific fluorine-based polymer is usually 0.1 to 10 mol %.

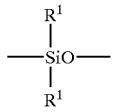

(1)

wherein $R^1$ and $R^2$ may be the same or different, and denote a hydrogen atom, an alkyl group, a halogenated alkyl group or an aryl group.

The fluorine content is preferably 30 wt % or more, more preferably 40 to 60 wt % in the specific fluorine-based polymer and the number-average molecular weight is preferably 5,000 or more, more preferably 10,000 to 500,000.

Here, the fluorine content is a value measured by the alizarin complexoen method, and the number-average molecular weight is a value when tetrahydrofuran is used as an eluate.

The specific fluorine-based polymer in the present invention can be obtained by reacting (a) a fluorine-containing olefin compound (hereinafter, referred to as "component (a)"), (b) a compound copolymerizable with the component (a) (hereinafter, referred to as "component (b)") and (c) an azo group-containing polysiloxane compound (hereinafter, referred to as "component (c)"), as necessary, (d) a reactive emulsifier (hereinafter, referred to as "component (d)").

As the component (a), a compound having at least one polymerizable unsaturated double bond and at least one fluorine atom is preferable, and examples include (i) fluoroolefins such as tetrafluoroethylene, hexafluoropropylene and 3,3,3-trifluoropropylene; (ii) alkyl perfluorovinyl ethers or alkoxyalkyl perfluorovinyl ethers; (iii) perfluoro(alkyl vinyl ethers) such as perfluoro(methyl vinyl ether), perfluoro (ethyl vinyl ether), perfluoro(propyl vinyl ether), perfluoro (butyl vinyl ether) and perfluoro(isobutyl vinyl ether); (iv) perfluoro(alkoxyalkyl vinyl ethers) such as perfluoro (propoxypropyl vinyl ether); and others. These compounds may be used alone or in combination of two or more.

Among them, hexafluoropropylene, perfluoroalkyl perfluorovinyl ether and perfluoroalkoxyalkyl perfluorovinyl ether are particularly preferable and, further, it is preferable that these are used in combination.

Examples of the component (b) copolymerizable with the component (a) include (i) alkyl vinyl ethers or cycloalkyl vinyl ethers such as methyl vinyl ether, ethyl vinyl ether, n-propyl vinyl ether, isopropyl vinyl ether, n-butyl vinyl ether, isobutyl vinyl ether, tert-butyl vinyl ether, n-pentyl vinyl ether, n-hexyl vinyl ether, n-octyl vinyl ether, n-dodecyl vinyl ether, 2-ethyl hexyl vinyl ether and cyclohexyl vinyl ether; (ii) carboxylic vinyl esters such as vinyl acetate, vinyl propionate, vinyl butyrate, vinyl pivalate, vinyl caprate, vinyl versatate and vinyl stearate; (iii) (meth) acrylic esters such as methyl (meth)acrylate, ethyl (meth) acrylate, n-butyl (meth)acrylate, isobutyl (meth)acrylate, 2-methoxyethyl (meth)acrylate, 2-ethoxyethyl (meth) acrylate and 2-(n-propoxy)ethyl (meth)acrylate; (iv) carboxyl group-containing monomer compounds such as (meth)acrylic acid, crotonic acid, maleic acid, fumaric acid and itaconic acid.

It is particularly preferable that the component (b) has a functional group. And by using such a component (b), a specific fluorine-based polymer becomes to have the functional group. Thereby, a curable resin composition having the preferable properties can be obtained. As a functional group, a hydroxyl group and an epoxy group are preferable, or both of them may be combined.

Examples of the monomer compound having a hydroxyl group include (i) hydroxyl group-containing vinyl ethers such as 2-hydroxyethyl vinyl ether, 3-hydroxypropyl vinyl ether, 2-hydroxypropyl vinyl ether, 4-hydroxybutyl vinyl ether, 3-hydroxybutyl vinyl ether, 5-hydroxypentyl vinyl ether and 6-hydroxyhexyl vinyl ether; (ii) hydroxyl group-containing allyl ethers such as 2-hydroxyethyl allyl ether, 4-hydroxybutyl allyl ether and glycerol monoallyl ether; (iii) allyl alcohol; (iv) hydroxyethyl (meth)acrylic ester; and the like.

Examples of the monomer compound containing an epoxy group include vinyl glycidyl ether, allyl glycidyl ether, glycidyl (meth)acrylate, glycidyl crotonate ester, methylglycidyl maleate ester and the like.

These compounds may be used alone or in combination of two or more.

Among the above-mentioned monomer compounds, alkyl vinyl ethers, cycloalkyl vinyl ethers, and vinyl carboxylate esters are suitably used from the viewpoint of a higher yield in a polymerization reaction for obtaining a specific fluorine-based polymer.

On the other hand, from the viewpoint of the higher content of fluorine to be copolymerized in a specific fluorine-based polymer, low-molecular monomers such as methyl vinyl ether, ethyl vinyl ether, n-propyl vinyl ether, isopropyl vinyl ether, vinyl acetate, vinyl propionate, vinyl butyrate and vinyl pivalate are preferred to use.

Further, in order to enhance the hardness of a thin film obtained after curing a coating film of a resin composition and to lower a refractive index, it is effective to use branched monomers such as isopropyl vinyl ether, tert-butyl vinyl ether and vinyl pivalate.

The azo group-containing polysiloxane compound as the component (c) is a compound containing an azo group which is represented by —N=N— and is easily cleaved thermally and, at the same time, having a polysiloxane segment represented by the above-mentioned general formula (1), and the compound can be prepared by the method described in, for example, JP-A-6-93100.

The component (c) may be used a compound represented by the following general formula (2).

(2)

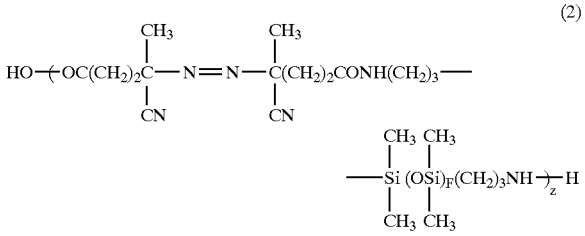

wherein y=10 to 500 and z=1 to 50.

Examples of a preferable combination of the above-mentioned component (a), (b) and (c) include (i) fluoroolefin/alkyl vinyl ether/polydimethylsiloxane unit, (ii) fluoroolefin/perfluoro(alkyl vinyl ether)/alkyl vinyl ether/polydimethylsiloxane unit, (iii) fluoroolefin/perfluoro(alkoxyalkyl) vinyl ether/alkyl vinyl ether/polydimethylsiloxane unit, (iv) fluoroolefin/(perfluoroalkyl) vinyl ether/alkyl vinyl ether/polydimethylsiloxane unit, and (v) fluoroolefin/(perfluoroalkoxyalkyl) vinyl ether/alkyl vinyl ether/polydimethylsiloxane unit.

The specific fluorine-based polymer according to the present invention is a polymer whose content of a structure unit derived from the component (a) is 20 to 70 mol %, preferably 25 to 65 mol %, more preferably 30 to 60 mol %. When the content of the structure unit derived from the component (a) is less than 20 mol %, the content of fluorine in the resulting specific fluorine-based copolymer becomes too small, and refractive index of the resulting cured product obtained by using a curable resin composition is not likely to be sufficiently low. On the other hand, when the content of the structure unit derived from the component (a) exceeds 70 mol %, the solubility of the resulting specific fluorine-based polymer in an organic solvent is remarkably reduced and, at the same time, the light transmitting properties of and the adherability to a substrate of the resulting curable resin composition become small.

The content of a structure unit derived from the component (b) in the specific fluorine-based polymer is 10 to 70 mol %, preferably 15 to 65 mol %, more preferably 30 to 60 mol %. When the content of the structure unit derived from the component (b) is less than 10 mol %, the solubility of the resulting specific fluorine-based polymer in an organic solvent is reduced. On the other hand, when the content of the structure unit derived from the component (b) exceeds 70 mol %, optical properties such as the light transmitting properties and the refractive index of the resulting cured product obtained by using a curable resin composition is inferior.

In addition, by using a monomer containing a hydroxyl group or an epoxy group as the component (b), the strength of a cured film can be improved, and preferable.

The content of the monomer containing a hydroxyl group or an epoxy group based on a whole monomer is 0 to 20 mol %, preferably 1 to 20 mol %, more preferably 3 to 15 mol %. When the content exceeds 20 mol %, the optical properties of the cured product obtained by using the resulting curable resin composition are insufficient and, a cured film becomes fragile in the case of using as a coating agent.

The azo group-containing polysiloxane compound as the component (c) is a thermal radical generator itself, and has a function as a polymerization initiator in a polymerization reaction for obtaining the above-mentioned specific fluorine-based polymer. Alternatively, another radical initiator may also be used. The content of the polysiloxane segment represented by the above-mentioned general formula (1) as a structure unit derived from the (c) component in the specific fluorine-based polymer is 0.1 to 20 mol %, preferably 0.1 to 15 mol %, more preferably 0.1 to 10 mol %. When the content of the polysiloxane segment represented by the above-mentioned general formula (1) exceeds 20 mol %, the light transmitting properties of the resulting specific fluorine-based polymer is lowered, and crawling and the like are easily caused during coating in the case of using as a coating agent.

In the present invention, it is preferable that the component (d) to be reacted with the above-mentioned component (a) to (c) may be used a reactive emulsifier as a monomer component. Use of the component (d) leads to better coating and leveling property in the case of using a specific fluorine-based polymer as a coating agent.

A nonionic reactive emulsifier as the reactive emulsifier is particularly preferable to use. The nonionic reactive emulsifier is not particularly limited and may be used a compound represented by the following general formula (3).

(3)

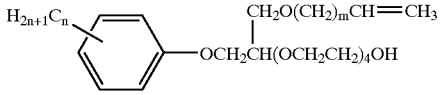

wherein n=1 to 20, m=0 to 4 and s=3 to 50.

The content of a structure unit derived from the component (d) in the specific fluorine-based polymer is usually 0 to 10 mol %, preferably, 0.1 to 5 mol %. When the content exceeds 10 mol %, the resulting curable resin composition becomes sticky so that the composition is difficult to be handled, and the resistance to humidity is lowered in the case of using as a coating agent.

Preferable combinations in the case of using the component (d) are as follows. Here upon, "a functional group" is a hydroxy group or an epoxy group.

(i) Fluoroolefin/alkyl vinyl ether/functional group-containing vinyl ether/polydimethylsiloxane unit/nonionic reactive emulsifier, (ii) fluoroolefin/perfluoro(alkyl vinyl ether)/alkyl vinyl ether/functional group-containing vinyl ether/polydimethylsiloxane unit/nonionic reactive emulsifier, (iii) fluoroolefin/perfluoro(alkoxyalkyl) vinyl ether/alkyl vinyl ether/functional group-containing vinyl ether/polydimethylsiloxane unit/nonionic reactive emulsifier, (iv) fluoroolefin/(perfluoroalkyl) vinyl ether/alkyl vinyl ether/functional group-containing vinyl ether/polydimethylsiloxane unit/nonionic reactive emulsifier, and (v) fluoroolefin/(perfluoroalkoxyalkyl) vinyl ether/alkyl vinyl ether/functional group-containing vinyl ether/polydimethylsiloxane unit/nonionic reactive emulsifier.

The specific fluorine-based polymer according to the present invention is produced by any method selected from the group consisting of an emulsion polymerization, a suspension polymerization, a bulk polymerization and a solution polymerization, which are used a radical polymerization initiator. A polymerization process is conveniently selected from batch type, semi-continuous type, continuous type and the like.

Examples of the radical polymerization initiator which can be used with the component (c) include (i) diacyl peroxides such as acetyl peroxide and benzoyl peroxide; (ii) ketone peroxides such as methyl ethyl ketone peroxide and cyclohexanone peroxide; (iii) hydroperoxides such as hydrogen peroxide, tert-butyl hydroperoxide and cumene hydroperoxide; (iv) dialkyl peroxides such as di-tert-butyl peroxides, dicumyl peroxides and dilauroyl peroxides; (v) peroxyesters such as tert-dibutyl peroxyacetate and tert-butyl peroxypivalate; (vi) azo-based compounds such as azobisisobutyronitrile and azobisisovaleronitrile; (vii) persulfate salts such as ammonium persulfate, sodium persulfate and potassium persulfate; and others.

Examples of radical polymerization initiators other than those as described above include iodine-containing fluorine compounds such as perfluoroethyl iodide, perfluoropropyl iodide, perfluorobutyl iodide, (perfluorobutyl)ethyl iodide, perfluorohexyl iodide, 2-(perfluorohexyl)ethyl iodide, perfluoroheptyl iodide, perfluorooctyl iodide, 2-(perfluorooctyl)ethyl iodide, perfluorodecyl iodide, 2-(perfluorodecyl)ethyl iodide, heptafluoro-2-iodopropane, perfluoro-3-methylbutyl iodide, perfluoro-5-methylhexyl iodide, 2-(perfluoro-5-methylhexyl)ethyl iodide, perfluoro-7-methyloctyl iodide, 2-(perfluoro-7-methyloctyl)ethyl iodide, perfluoro-9-methyldecyl iodide, 2-(perfluoro-9-methyldecyl)ethyl iodide, 2,2,3,3-tetrafluoropropyl iodide, 1H, 1H, 5H-octafluoropentyl iodide, 1H, 1H, 7H-dodecafluoroheptyl iodide, tetrafluoro-1,2-diiodoethane, octafluoro-1,4-diiodobutane, dodecafluoro-1,6-diiodohexane and the like.

Iodine-containing fluorine compounds may be used alone or with an organic peroxide, an azo-based compound or a persulfate.

It is preferable that a polymerization reaction for the specific fluorine-based polymer is conducted in a solvent system using a solvent. Examples of a preferable organic solvent include (i) esters such as ethyl acetate, butyl acetate, isopropyl acetate, isobutyl acetate and cellosolve acetate; (ii) ketones such as acetone, methyl ethyl ketone, methyl isobutyl ketone and cyclohexanone;(iii) cyclic ethers such as tetrahydrofuran and dioxane; (iv) amides such as N,N-dimethylformamide and N,N-dimethylacetamide; (v) aromatic hydrocarbons such as toluene and xylene; and others. Further, alcohols, aliphatic hydrocarbons or the like may also be used as necessary.

The resulting reaction solution containing the resulting specific fluorine-based polymer may be used as a curable resin composition in some cased, and it is optional to post-treat the polymerization solution conveniently.

The post-treatment may be a general re-precipitation treatment which is a typical purifying method of adding a polymerization solution dropwise to an insolubilizing solvent of a specific fluorine-based polymer exemplified an alcohol or the like to coagulate the specific fluorine-based polymer. And dissolving the resulting solid copolymer in a solvent leads to a solution containing a specific fluorine-based polymer.

In addition, what removes a remaining monomer and is produced may be used as a solvent of the specific fluorine-based polymer.

<Curable Resin Composition>

The curable resin composition used for forming an anti-fouling resin layer may be a composition having a curing property after coating. That is, when the specific fluorine-based polymer itself has a sufficient curing property, it is not necessary to use a crosslinkable compound, and the curable resin composition is the one containing a specific fluorine-based polymer and a solvent. When the polymer itself has not a sufficient curing property, incorporating a crosslinkable compound is preferable and the necessary curing property is given and the curing property can be improved.

And, when a crosslinkable compound is used, the curable resin composition may be a mixture of the crosslinkable compound and a specific fluorine-based polymer, a reaction product obtained by reacting all of a specific fluorine-based polymer and a crosslinkable compound, or a mixture containing a reaction product obtained by reacting a part of them.

<Crosslinkable Compound>

Examples of the crosslinkable compound include various amino compounds, various hydroxyl group-containing compounds such as pentaerythritol, polyphenol and glycol, and others.

The amino compound used as the crosslinkable compound is a compound containing a total of two or more of an amino group which can react with a hydroxyl group or an epoxy group present in the fluorine-based polymer, for example, a hydroxyalkylamino group and/or an alkoxyalkylamino group. Examples of the amino compound include a melamine-based compound, a urea-based compound, a benzoguanamine-based compound and a glycoluryl-based compound.

The melamine-based compound is generally known as a compound having a skeleton in which a nitrogen atom is bound to a triazine ring. Examples of the melamine-based compound include melamine, alkylated melamine, methylolated melamine, alkoxylated methylmelamine and the like. A melamine-based compound having a total of two or more of a methylol group and/or an alkoxylated methyl group in the molecule is preferable, especially methylolated melamine which is obtaind by reacting melamine and formaldehyde under the basic condition, and alkoxylated methylmelamine and derivatives thereof are preferable. Alkoxylated methylmelamine is particularly preferable in that better storage stability and better reactivity is given to the curable resin composition.

Methylolated melamine and alkoxylated methylmelamine used as a crosslinkable compound are not particularly limited, but various resinous materials obtained by the method described in, for example, the literature "Course of Plastic Material [8] Urea Melamine Resin" (published by Nikkankogyoshinbunsha) may be used.

Examples of the urea-based compound include, in addition to urea, polymethylolated urea and alkoxylated methylurea which is a derivative of polymethylolated urea, methylolated uron having an uron ring and alkoxylated methyluron, and the like. Also in compounds such as urea derivatives, various resinous materials described in the above-mentioned literature may be used.

An amount of the crosslinkable compound to be formulated is 70 parts by weight or less, preferably 3 to 50 parts by weight, more preferably 5 to 30 parts by weight based on 100 parts by weight of the specific fluorine-based polymer. When the amount of the crosslinkable compound to be used is too small, the durability of a thin membrane formed of the resulting curable resin composition is insufficient in some cases. When the amount exceeds 70 parts by weight, it is difficult to avoid gelling in a reaction with the specific fluorine-based polymer and, further, a cured membrane has no low refractive index and the cured product becomes fragile in some cases.

A reaction between a specific fluorine-based polymer and a crosslinkable compound may be performed, for example, by adding the crosslinkable compound to a solution obtained by dissolving the specific fluorine polymer in an organic solvent, which is heated and stirred for a suitable time to uniformize the reaction system. A heating temperature for the reaction is generally in a range of 30 to 150° C., preferably in a range of 50 to 120° C. When the heating temperature is lower than 30° C., the reaction proceeds extremely slow and, when the temperature is 150° C. or higher, a crosslinking reaction between methylol group or alkoxylated methyl group in the crosslinkable compound is caused in addition to an end reaction and, thus, a gel is produced, being not preferable.

Progress of the reaction can be confirmed quantitatively by quantitating a methylol group or an alkoxylated methyl group with an infrared spectroscopy or the like, or by recovering the dissolved polymer with a re-precipitating method and measuring an amount of increase thereof.

In the reaction between the specific fluorine-based polymer and the crosslinkable compound, it is preferable to use an organic solvent, for example, which is the same organic solvent as that used in preparing the specific fluorine-based polymer.

In the present invention, a reaction solution containing a specific fluorine-based polymer and a crosslinkable compound may be used as a solution of the curable resin composition as it is, or after various additives are incorporated therein, as necessary.

<Additive>

The above-mentioned curable resin composition may contain various additives such as various polymers or monomers having a hydroxyl group, a coloring agent such as a pigment and a dye, a stabilizing agent such as an anti-aging agent and an ultraviolet absorbing agent, a thermal acid generator, a photosensitive acid generator, a surfactant, a solvent, a polymerization inhibitor and the like in order to improve the coating property of the curable resin composition and the properties of a thin membrane after curing, imparting of the photosensitivity to a coated film and the like.

In order to improve the hardness and the durability of a formed cured membrane, it is particularly preferable that a thermal acid generator or a photosensitive acid generator is added and it is particularly preferable that a material which does not lower the light transmitting properties of the cured membrane obtained by using the curable resin composition and is uniformly dissolved in the solution, is selected for use.

<Polymer Having Hydroxyl Group>

Examples of a polymer having a hydroxyl group which can be contained in the curable resin composition include a polymer obtained by copolymerizing a hydroxyl group-containing copolymerizable monomer such as hydroxyethyl (meth)acrylate and the like, a resin having a phenol skeleton which is known as a novolak resin or a resol resin, and the like.

<Coloring Agent Such as Pigment and Dye>

Examples of the coloring agent which can be contained in the above-mentioned curable resin composition include (i) extender pigments such as alumina white, clay, barium carbonate and barium sulfate; (ii) inorganic pigments such as zinc white, lead, chrome yellow, red lead, ultramarine, Prussian blue, titanium oxide, zinc chromate, red iron oxide, carbon black and the like; (iii) organic pigments such as brilliant carmine 6B, permanent red 6B, permanent red 6R, benzidine yellow, phthalocyanine blue, phthalocyanine green and the like; (iv) basic dyes such as magenta, rhodamine and the like; (v) direct dyes such as direct scarlet, direct orange and the like; (vi) acid dyes such as rhoserine, metanyl yellow and the like; and others.

<Stabilizing Agent Such as Anti-aging Agent and Ultraviolet Absorbing Agent>

As the anti-aging agent or the ultraviolet absorbing agent which can be contained in the above-mentioned curable resin composition, the known ones can be used.

Examples of the anti-aging agent include di-tert-butylphenol, pyrogallol, benzoquinone, hydroquinone, methylene blue, tert-butyl catechol, monobenzylether, methylhydroquinone, amylquinone, amyloxyhydroquinone, n-butylphenol, phenol, hydroquinone monopropyl ether, 4,4'-[1-[4-(1-(4-hydroxyphenyl)-1-methylethyl)phenyl]ethylidene]diphenol, 1,1,3-tris(2,5-dimethyl-4-hydroxyphenyl)-3-phenylpropane, diphenylamines, phenylenediamines, phenothiazine, mercaptobenzimidazole and the like.

Examples of the ultraviolet absorbing agent include a salicylic acid-based ultraviolet absorbing agent such as phenyl salicylate, a benzophenone-based ultraviolet absorbing agent such as dihydroxybenzophenone and 2-hydroxy-4-methoxybenzophenone, a benzotriazole-based ultraviolet absorbing agent, cyanoacrylate-based ultraviolet absorbing agent and the like which are used as an additive for various plastics.

<Thermal Acid Generator>

The thermal acid generator which can be contained in the above-mentioned curable resin composition is a material that improves the heating condition into a milder one when a coating film of the curable resin composition is heated to cure.

Examples of the thermal acid generator include various aliphatic sulfonic acids and salt thereof, various aliphatic carboxylic acids such as citric acid, acetic acid and maleic acid and salts thereof, various aromatic carboxylic acids and such as benzoic acid and phthalic acid salts thereof, alkylbenzenesulfonic acid and ammonium salt thereof, various metal salts, phosphoric ester of phosphoric acid and organic acid, and the like.

An amount of the thermal acid generator to be formulated is usually 0 to 10 parts by weight, preferably 0.1 to 5 parts by weight based on 100 parts by weight of the specific fluorine-based polymer in the curable resin composition. When the amount of the thermal acid generator becomes large, the storage stability of the curable resin composition is deteriorated, being not preferable.

<Photosensitive Acid Generator>

The photosensitive acid generator which can be contained in the above-mentioned curable resin composition is a material that gives a photosensitivity to a coating of the curable resin composition, for example, which allows the coating to be photo-cured by irradiating with radiation such as the light or the like.

Example of the photosensitive acid generator include (i) onium salts such as an iodonium salt, a sulfonium salt, a phosphonium salt, a diazonium salt, an ammonium salt and a pyridinium salt; (ii) sulfone compounds such as β-ketoester, β-sulfonylsulfone and α-diazo compounds thereof; (iii) sulfonic esters such as alkylsulfonic ester, haloalkylsulfonic ester, arylsulfonic ester and iminosulfonate; (iv) sulfonimide compounds represented by the following general formula (4); (v) diazomethane compounds represented by the following general formula (5); and the like.

(4)

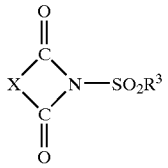

wherein X denotes a divalent group such as an alkylene group, an arylene group and an alkoxylene group, and $R^3$ denotes a monovalent group such as an alkyl group, an aryl group, a halogen-substituted alkyl group and a halogen-substituted aryl group.

(5)

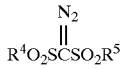

wherein $R^4$ and $R^5$ may be the same or different and denote a monovalent group such as an alkyl group, an aryl group, a halogen-substituted alkyl group and a halogen-substituted aryl group.

The photosensitive acid generators may be used alone or in combination of two or more, or jointly with the above-mentioned thermal acid generator.

An amount of the photosensitive acid generator to be formulated is usually 0 to 20 parts by weight, preferably 0.1 to 10 parts by weight based on 100 parts by weight of the specific fluorine-based polymer in the curable resin composition. When the amount of the photosensitive acid generator becomes too large, the strength of the cured membrane is deteriorated, and the light transmitting properties is lowered, being not preferable.

<Polymerization Inhibitor>

Examples of the polymerization inhibitor which can be contained in the above-mentioned curable resin composition include pyrogallol, benzoquinone, hydroquinone, methylene blue, tert-butylcatechol, monobenzyl ether, methylhydroquinone, amylquinone, amyloxyhydroquinone, n-butylphenol, phenol, hydroquinone monopropyl ether, 4,4'-[1-[4-(1-(4-hydroxyphenyl)-1-methylethyl)phenyl] ethylidene]diphenol, 1,1,3-tris(2,5-dimethyl-4-hydroxyphenyl)-3-phenylpropane and the like.

The polymerization inhibitor is preferably used in an amount of 5 parts by weight or less based on 100 parts by weight of the curable resin composition.

<Surfactant>

The surfactant is used in order to improve the coating property of the curable resin composition. As the surfactant, the known ones may be used. Specifically, for example, various anionic surfactants, cationic surfactants or nonionic surfactants may be contained. It is particularly preferable to use a fluorine-based surfactant because a cured membrane has an excellent strength and better optical properties.

An amount of the surfactant to be formulated is preferably 5 parts by weight or less based on 100 parts by weight of the curable resin composition.

<Solvent>

The curable resin composition usually contains a solvent. And, this curable resin composition is usually obtained as a solution contained in a solvent used for preparing the specific fluorine-based polymer, or in a solvent used for reacting the specific fluorine-based polymer and the crosslinkable compound and, therefore, the composition itself contains a solvent. Another solvent may be added and formulated therein in order to improve the coating property of the curable resin composition or for other purpose.

Examples of the preferable solvent include ketones such as methyl ethyl ketone, methyl isobutyl ketone and cyclohexanone, and esters such as ethyl acetate and butyl acetate.

Further, in a solution of the curable resin composition, a solvent which can not dissolve the specific fluorine-based polymer, for example, a poor solvent such as water, alcohols and ethers, may be used jointly in such a range that the specific fluorine-based polymer is not precipitated. Thereby, a solution containing the specific fluorine-based polymer has a better retaining property and a preferable coating property in some cases. Examples of such the poor solvent include ethyl alcohol, isopropyl alcohol, tert-butyl alcohol and the like.

(Method of Forming a Coating)

It is preferable that the above-mentioned curable resin composition is coated on at least a transparent part of the substrate part in the state of a solution. That is, in the case of a substrate part whose whole part is transparent, the composition may be coated on the whole face, and in the case of a substrate part having both a transparent part and a non-transparent part, the composition may be coated only on the transparent part or may be coated on the whole face including the non-transparent part. In addition, the composition may be coated only on an upper surface (polishing side) of the substrate part and, further, may be coated also on a lower surface and, further, may be coated also on a side.

As a coating method, the known coating methods can be used and, various methods such as a dipping method, a coater method and a printing method can be applied.

A thickness of a cured membrane after curing is not particularly limited, but from the viewpoint of the antifouling property, it is preferably 100 Å or more, more preferably 200 to 20,000 Å, most preferably 500 to 5,000 Å.

It is particularly preferable to give the thermal hysteresis by heating to a coating of the curable resin composition to be formed by coating, in order to obtain a cured membrane having the excellent optical properties and the durability. Anyway, when allowing to stand at a normal temperature, a curing reaction proceeds with time and a desired cured membrane is formed. However, actually, curing by heating is effective to shorten a required time.

In addition, including a thermal acid generator as a curing catalyst in the curable resin composition leads to promote a curing reaction. The curing catalyst is not particularly limited, but the above-mentioned various acids or salts thereof which have been generally used as a curing agent for a urethane resin, a melamine resin and the like, can be utilized. An ammonium salt is particularly preferably used.

Although the heating conditions for a curing reaction can be appropriately selected, it is necessary that a heating temperature is not higher than a heat resistance limit temperature of a substrate to be coated.

2. Polishing Pad

The polishing pad of the present invention is provided with a window member. Position of the window member is not particularly limited. Examples include (i) a case wherein a window member 22 is fitted or inserted in a through hole or a concave part provided in a substrate for a polishing pad (see FIGS. 3 to 11 and 13 to 15), (ii) a case wherein a window member 22 is adhered to a substrate for a polishing pad so as to cover an opening part of a through hole (see FIGS. 12 to 17), (iii) a case wherein a window member 22 is arranged between a substrate for a polishing pad and a supporting layer to be laminated on this bottom side (see FIGS. 16 and 17), and the like. If necessary, each part may be fixed with an adhesive. In FIGS. 12 to 15, and 17, No.15 denotes an adhesive layer. In addition, as shown in FIG. 11, at least a bottom (for example, a thin part 11*a* etc.) of a substrate for a polishing pad 11 arranged so as to cover a lower side of the window member needs a transparency to an extent that the light transmits. Further, as shown in FIGS. 16 and 22, at least a bottom [for example, a thin part 2*a* (see FIG. 16) or a thick part 2*b* (see FIG. 22) etc.] of a supporting layer 2 arranged so as to cover a lower side of the window member also needs the light transmitting properties to an extent that the light transmits. All of the above-mentioned substrate 11 for the above-mentioned polishing pad and the supporting layer 2 may be transparent.

(1) Polishing Pad Having a Window Member (Substrate for Polishing Pad)

The "substrate for a polishing pad" can usually retain a slurry on the surface thereof and, further, can have a polishing wastage reside thereon transiently. A whole shape of the polishing pad is not particularly limited, but may be circle (disc-like etc.), polygon (square etc.), belt shape, and the like. In the present invention, disc-like and belt shapes are particularly preferable. A size thereof is not also particularly limited. For example, in the case of a disc-like shape, a diameter may be 500 to 900 mm and, in the case of a belt shape (endless), an entire length may be 1,500 to 3,000 mm, a lateral width may be 200 to 500 mm.

In addition, transmitting properties of the substrate having a window member does not need to consider.

Further, it is preferable that a fine hole (hereinafter, referred to as "pore") or a groove is formed on the surface of the substrate for a polishing pad at least until polishing, in order to retain a slurry during polishing and have a polishing wastage reside thereon transiently as described above. That is, a pore and/or a groove may be formed on a substrate for a polishing pad in advance (for example, a foam etc.), or a pore and/or a groove may be formed thereon by eliminating particles and the like off during polishing. As the latter, a matrix material in which a water-soluble material (particle shape, linear shape etc.) having a prescribed shape is dispersed, can be used as the substrate for a polishing pad. In such the substrate for a polishing pad, a pore and/or a groove is formed on a part where a water-soluble material is eliminated off or dissolved by contact with an aqueous medium.

A material constituting a substrate for a polishing pad is not particularly limited, but various materials can be used, and it is particularly preferable that an organic material is used because it is easily molded into a prescribed shape and nature and can give the suitable elasticity. As this organic material, various materials which can be applied as the above-mentioned substrate part material constituting a window member and the like, can be used. Examples thereof include curable resins such as 1,2-polybutadiene, a urethane resin, an epoxy resin, an acrylic resin, an unsaturated polyester resin and a vinyl ester resin, and crosslinked rubbers obtained by crosslinking a butadiene rubber, an isoprene rubber, an acrylic rubber, an acrylonitrile-butadiene rubber, a styrene-butadiene rubber, an ethylene-propylene rubber, a silicone rubber, a fluorine rubber and a styrene-isoprene rubber. In particular, a substrate for a polishing pad having a belt shape needs the flexibility like a window member. As a material in this case, a polyurethane resin and crosslinked 1,2-polybutadiene are preferable. A material constituting the substrate for a polishing pad and a substrate part material may be the same or different.

In addition, when the above-mentioned water-soluble material which is eliminated off during polishing is dispersed for the purpose of forming a pore and/or a groove on the surface of the substrate for a polishing pad, an organic water-soluble material and an inorganic water-soluble material can be used as a water-soluble material. Examples of the organic water-soluble material include dextrin, cyclodextrin, mannit, sugars (lactose etc.), celluloses (hydroxypropylcellulose, methylcellulose etc.), starch, protein, polyvinyl alcohol, polyvinyl pyrrolidone, polyacrylic acid, polyethylene oxide, water-soluble photosensitive resin, sulfonated polyisoprene, sulfonated polyisoprene copolymer and the like. Further, examples of the inorganic water-soluble material include potassium acetate, potassium nitrate, potassium carbonate, potassium hydrogencarbonate, potassium chloride, potassium bromide, potassium phosphate, magnesium nitrate and the like.

The "through hole" penetrates through a substrate for a polishing pad from a surface to a back and is provided for fitting with a window member. The through hole may be completely filled with a window member (FIGS. 4 and 6 etc.), or a part thereof may be filled with a window member (FIGS. 5 and 7 etc.). A shape of the through hole is not particularly limited. For example, referring to FIGS. 18 to 26, a planar shape of an opening part thereof may be circle (see FIG. 23), ellipse (see FIG. 25), track shape, square shape in which four corners are beveled, fan, polygon (regular square; see FIG. 24, general trapezoid (see FIG. 18) and general long rectangle (groove-like); (see FIGS. 26 and 20) and ring-like (see FIG. 21) and the like. In addition, a cross-sectional shape of the through hole may be, for example, T letter shape, reverse T letter shape, square or other shape (see FIGS. 3 to 10, wherein an upper side is a polishing side in each figure). Among them, T letter shape is particularly preferable.

A size of the through hole is not particularly limited. Usually, when an opening part is circle, it is preferable that a diameter is 20 mm or more (usually, ⅔ or less a radius of a polishing pad). In the case of an annular through hole, it is preferable that a width thereof is 20 mm or more (usually, ⅔ or less a radius of a polishing pad). In the case of square, it is preferable that a longitudinal size is 30 mm or more (usually, ⅔ or less a radius of a polishing pad) and a transverse size is 10 mm or more (usually, ⅔ or less a radius of a polishing pad). When each through hole becomes smaller than the above-mentioned size, it becomes difficult to assuredly transmit the light used for endpoint detection in some cases.

Further, the number of through holes is not particularly limited, but may be one, or two or more. Position thereof is not also particularly limited. For example, referring to FIGS. 12 to 15, when an entire shape is disc-like, in order to provide one through hole, it can be arranged as shown in FIG. 12 (planar rectangular) or FIG. 15 (ring-like). In order to provide a plurality of through holes, they may be arranged concentrically (FIG. 13; planar rectangular shape. FIG. 14; planar long rectangular (groove-like)) or in other format. In addition, referring to FIG. 17, in the case of a belt type, a plurality of through holes may be arrayed (linear arrangement, irrespective of an end side or a central side) or arranged in other format (zigzag-like, arrangement in which a group of a plurality of holes is repeated in an array). This array may be on an end side as shown in FIG. 17, or may be on a central side.

Further, the substrate for a polishing pad may have a concave part having a certain depth. In this case, a substrate has a thin part 11*a* under the concave part (see FIG. 11). This concave part in which the thin part is to be formed is a place where a window member is inserted. A planar shape and a longitudinal cross-sectional shape of the concave part are not particularly limited, but may be the same as the planar shape (see FIGS. 12 to 19) and the longitudinal cross-sectional shape of the above-mentioned through hole, for example. An upper side (an open side of the concave part) in these figures is a side to be polished. When a material constituting the substrate for a polishing pad has the light transmitting properties, by providing a thin part, the light transmitting properties at the thin part can be further enhanced. Therefore, even when it is difficult to transmit the light having the sufficient strength for detecting a polishing endpoint through parts other than this thin part, the sufficient strength of the light for endpoint detection can be maintained at a thin part.

Further, the number of concave parts is not particularly limited, but may be one, or two or more. In addition, position thereof is not particularly limited, but may be arranged as in the above-mentioned through hole (see FIGS. 12 to 15, FIGS. 17 to 19).

A thickness of the thin part is not particularly limited. Usually, it is preferable that a thinnest thickness of the thin part is preferably 0.1 mm or more, more preferably 0.3 mm or more, but usually 3 mm or less. When the thickness is less than 0.1 mm, there is a tendency that it becomes difficult to obtain a sufficient mechanical strength at this part. In addition, a size of the thin part is not particularly limited. For example, in the case of circle, it is preferable that a diameter is 20 mm or more. In the case of an annular shape, it is preferable that a width thereof is 20 mm or more. In the case of rectangle, it is preferable that a longitudinal size is 30 mm or more and a transverse size is 10 mm or more.

(Window Member)

The window member explained in the above-mentioned item 1. is applied to this window member. And, a planar shape of a polishing side of the window member usually depends on a shape of a through hole or that of a concave part formed in a polishing pad. Usually, a shape of a window member is the same as that of a through hole or a concave part, and may be circle, polygon or the like. In addition, a cross-sectional shape thereof is particularly limited, but may be usually a shape in which at least a part thereof is fitted or inserted into a through hole or a concave part, or a shape in which at least a part thereof is adhered to an opening part of a through hole. For example, cross-sectional shapes shown in FIG. 3 to FIG. 17 may be used. The window member may be fitted in the above-mentioned substrate for a polishing pad and, at the same time, may be adhered by an adhesive or the like. The adhesive is not particularly limited to use.

The window member is wholly fitted or inserted in the through hole (see FIGS. 3 to 10). In addition, a convex part of the window member having a longitudinal cross-section of a reverse T letter shape may be fitted, and a plate part (bottom part) may be adhered to a substrate for a polishing pad so as to protrude from the through hole (see FIG. 13). Alternatively, the window member may be inserted so that there is a gap between the window member and the through hole (see FIG. 14). Further, an upper level of the window member to be inserted may be lower than an upper level of the substrate for a polishing pad, forming a difference in level on the surface of a substrate for a polishing pad (see FIG. 15). In this case, the above-mentioned gap may be present or absent.

In addition, the window member may be adhered to the substrate for a polishing pad so as to cover an opening part of a through hole (see FIGS. 12 to 17). In this case, a plate-like or sheet-like window member may be fixed by adhering to a lower surface of the substrate for a polishing pad (see FIG. 12). In this case, a vacancy part or the like for inserting the window member may be provided on a lower side of the substrate for a polishing pad and the window member may be fixed by connecting with the vacancy part. Further, a convex part of the window member having a longitudinal cross-section of a reverse T letter shape may be fitted or inserted in the through hole and, at the same time, the plane part (bottom part) may be adhered to a substrate for a polishing pad (see FIGS. 13 to 15). Any kind of adhesives is available in this case, but it is convenient to use a both sides coated adhesive tape.

The number of window members is not particularly limited, but is corresponding to the number of through holes or concave parts because a window member is fitted or inserted in a through hole or concave part. That is, the number may be one, two or more. In addition, position of the window member is corresponding to the shape of through hole or concave part as described above. For example, referring to FIGS. 18 to 21, when a whole shape is disc-like, in order to provide one window member, it can be arranged as in FIG. 18 (in the case of a planar rectangular window member) or FIG. 21 (in the case of ring-like window member). When a plurality of window members are provided, they can be arranged concentrically (FIG. 19; planar rectangular window member, FIG. 20; planar long square (groove-like) window member) or in another format. In addition, in the case of a belt type, referring to FIGS. 23 to 26, a plurality of window members (FIG. 25 is a view in which a plurality of window members are arranged at a large interval) may be arrayed (linear arrangement irrespective of an end side or a central side) or arranged in another format (zigzag-like, a group of a plurality of window members is repeated in an array manner). This array may be on an end side as in FIGS. 23 to 26, or on a central side.

In this case, a thickness of the window member is usually the same as that of the substrate for a polishing pad (see FIG. 8 etc.), but not limited, and the window member may be thinned. Thinning means making a thickness of a window member thinner than a maximum thickness of a substrate for a polishing pad (for example. FIG. 5, FIGS. 7 to 9, etc.) and forming a part of a window member through which the light transmits thinner in the window member itself (for example, FIG. 10 etc.).

When the light transmits through a window member, an intensity of the light is reduced in proportion to square of the thickness of the window member or the like through which the light transmits. Therefore, by thinning the window member or the like, the light transmitting properties can be dramatically improved. For example, in a polishing pad used for polishing in which endpoint detection is performed optically, even when it is difficult to obtain the sufficient intensity of the light for detecting an endpoint in the case of a window member having the same thickness as that of other parts of the polishing pad, by thinning a window member, a sufficient intensity of the light for endpoint detection can be ensured. It is preferable that a thickness of the thinned window member is 0.1 mm or more, more preferably 0.3 mm or more, usually 3 mm or less. When the thickness is less than 0.1 mm, there is a tendency that it becomes difficult to sufficiently maintain the mechanical strength of the window member.

Although a concave part 14 in FIG. 5 and a concave part 13 in FIG. 10 may be formed on a surface or a back of the polishing pad, respectively. By formation on the back, the window member or the like can be thinned without influencing on the polishing performance.

Further, a window member may be interposed between substrates which are divided into at least two parts, for example, substrates which are divided into two parts (see FIG. 27) and may be fixed by adhesion. In this case, a belt-like window member is used as shown in FIG. 2. In addition, as shown in FIG. 27, it is usually applied to a belt-like polishing pad. A position of the window member to be arranged may be on an end, or a center.

It is preferable that the transmitting properties of the window member is as follows, that is, in the case where a thickness of the window member is 2 mm, a light transmittance at a wavelength between 100 and 3,000 nm is 0.1% or more, or an integrated transmittance in a proper wavelength range between 100 and 3,000 nm is 0.1% or more. This transmittance or integrated transmittance is preferably 1% or more, more preferably 2% or more. However, this transmittance or integrated transmittance may not be higher than that as required. Usually, it may be 50% or less, further 30% or less, particularly 20% or less.

Further, the whole polishing pad of the present invention may contain, in addition to the window member, an abrasive, an oxidizing agent, a hydroxide of an alkali metal, an acid, a pH adjusting agent, a surfactant, a scratch inhibitor and the like in such a range that the transmitting properties can be maintained.

Besides, further, various additives such as a filler, a softening agent, an antioxidant, an ultraviolet absorbing agent, an antistatic agent, a lubricant, a plasticizer and the like may be contained therein. In particular, as the filler, materials which increase the rigidity such as calcium carbonate, magnesium carbonate, talc, clay and the like, and materials having the polishing effects such as silica, alumina, ceria, zirconia, titania, manganese dioxide, dimanganese trioxide, barium carbonate and the like may be used.

(2) Polishing Pad Comprising a Multi-layered Body for Polishing with a Supporting Layer on a Back A polishing pad of the present invention may be provided with a supporting layer 2 on a back of a substrate (see FIGS. 16, 17 and 22).

The "supporting layer" is a layer to be laminated on a back which is an opposite side relative to a polishing side of the polishing pad. In this case, the whole bottom including a substrate for a polishing pad and a window member may be covered (see FIG. 22). Or only a substrate for a polishing pad except for a window member may be covered. In the case a supporting layer comprised of a material having the light transmitting properties equal to or superior over that of the window member is used, the light transmitting properties in the multi-layered body for polishing can be maintained. In this case, a vacancy part may be or may not be formed on a part corresponding to a window member. In addition, when a support having no light transmitting properties is used, notching a part through which the light transmits makes light transmitting properties of the multi-layered body for polishing maintained.

Further, in the case a supporting layer is laminated on a bottom of a substrate for a polishing pad, when a window member is sheet-like, for example, the window member may be held between the substrate for a polishing pad and the supporting layer (see FIGS. 16 to 17). As shown in FIG. 17, a part (for example, both ends etc.) of the window member may be inserted. This case includes (i) a window member is simply held between a substrate for a polishing pad and a supporting layer (a vacancy part or the like shown below is formed nowhere), (ii) a concave part or a vacancy part is provided on a supporting layer so as to insert a window member therein, whereby, a window member is held therein, and (iii) a vacancy part or the like for inserting a window member is provided on a lower side of a substrate for a polishing pad, whereby, a window member is held therein. FIG. 17 is conveniently an illustration including an aspect of the (i) and that of (ii).

A shape of the supporting layer is not particularly limited, but a planar shape may be, for example, polygon (square etc.), a circle and the like. The supporting layer may also be a thin plate. The supporting layer usually has the same planar shape as that of a polishing pad (when a part for maintaining light transmitting properties by a vacancy part is given, the part is excluded).

A material constituting the supporting layer is not particularly limited, but a variety of materials may be used. In particular, it is preferable that an organic material is used because it is easily molded into a prescribed shape and nature and also it can give the suitable elasticity. As this organic material, materials which are applied to a substrate part material constituting the above-mentioned window member can be used, provided that, a material constituting the above-mentioned supporting layer and a material constituting the substrate part material of the above-mentioned window member may be the same or different.

In addition, a hardness of the supporting layer is not particularly limited, but the supporting layer is preferably softer than a substrate for a polishing pad. Whereby, a polishing pad as a whole has a sufficient flexibility, and it can be appropriately adapted to the irregularity of the surface to be polished. In particular, in the case of using a belt-like polishing pad, one having a flexibility is preferable.

In addition, the number of the supporting layers is not limited. The supporting layer may be one layer, or a laminate of two or more layers. Further, in the case where two or more supporting layers are laminated, respective layers may be composed of the same component, or may be composed of the different component.

The present polishing pads have light transmitting properties due to provision of a window member and enable the light to transmit through the window member. For this reason, in polishing using the present polishing pads, observing the polishing situations with an optical method is possible. That is, for example, the polishing pads are suitable for polishing a wafer using an optical endpoint detecting apparatus.

(Method of Polishing a Semiconductor Wafer)

Polishing a semiconductor wafer can be carried out using a polishing pad and detecting a polishing endpoint of the semiconductor wafer using an optical endpoint detector.

The "optical endpoint detector" is an apparatus which can observe the polishing situations with the light reflected from the surface of a material to be polished through a transparent window member or a chemical mechanical polishing window member and a polishing endpoint of a side to be polished, and can detect a polishing endpoint. Other measuring principles are not particularly limited.

According to this method of polishing a semiconductor wafer, polishing can be performed while always observing a polishing endpoint, for example, (i) by arranging window members on a disc center and concentrically or by using a ring-like window member where the polishing pad or the polishing multi-layered body is disc-like, (ii) by arraying window members parallel in the case of a belt-like polishing pad, or the like. Therefore, polishing can be finished assuredly at an optimal polishing endpoint.

In the case of polishing a semiconductor wafer, for example, a polishing apparatus as shown in FIG. 22 or FIG. 28 may be used. That is, such the polishing apparatus is an apparatus provided with a rotatable surface plate 2 or a belt-like polishing pad 1, a pressure head 3 which can rotate and move in a longitudinal direction and a transverse direction, a slurry supplying part 5 which can add a slurry dropwise on the surface plate 2 at a certain amount per unit time, and an optical endpoint detecting part 6 which is arranged under the surface plate 2 or the belt-like polishing pad 1.

The above-mentioned "slurry" means an aqueous dispersion containing at least an abrasive. However, the slurry or only an aqueous medium without abrasive may be supplied from the outside during polishing. When only an aqueous medium is supplied, for example, the slurry can be formed by mixing an abrasive released from the interior of the polishing pad and the aqueous medium during polishing.

In this polishing apparatus, a disc-like or another shaped polishing pad 1 is fixed on a surface plate (FIG. 22), or a belt-like polishing pad is transferred by a roll (FIG. 28) and, on the other hand, a semiconductor wafer 4 is fixed on a lower end of the press head 3, and the semiconductor wafer 4 is abutted against a polishing pad by pushing at a prescribed pressure. And, polishing is performed by sliding a semiconductor wafer and a polishing pad by rotating a surface plate or a belt-like polishing pad and a pressure head while a prescribed amount of the slurry is added dropwise on the polishing pad or the like from a slurry supplying part.

Upon this polishing, the endpoint detecting light $R_1$ having a prescribed wavelength or a wavelength region is irradiated to the surface to be polished of the semiconductor wafer through the window member 12 from a lower side of the surface plate 2(the endpoint detecting light or a belt-like polishing pad can transmit the surface plate when the surface plate itself has the light transmitting properties or a vacancy part is formed at a part of surface plate), from an optical endpoint detecting part 6. Then, the reflected light $R_2$ which is this endpoint detective light reflected on the surface of the semiconductor wafer to be polished is captured by the optical endpoint detecting part 6, and polishing can be performed while observing the situations of the surface to be polished from this reflected light.

EXPLANATION OF REFERENCE CHARACTER

Figure 1:
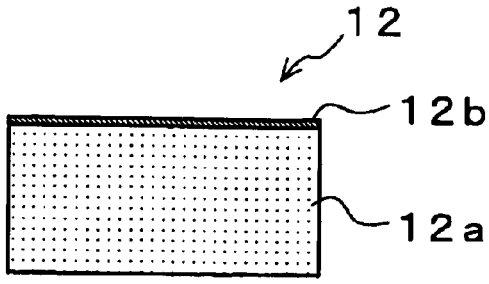
FIG. 1 is a longitudinal cross-section of a window member for chemical mechanical polishing.
Figure 2:
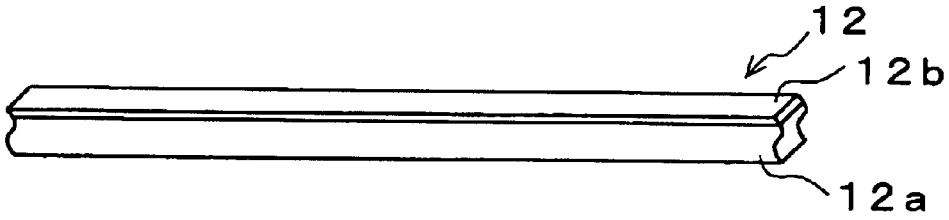
FIG. 2 is a perspective of a part of a belt-like window member for chemical mechanical polishing as another aspect.
Figure 3:
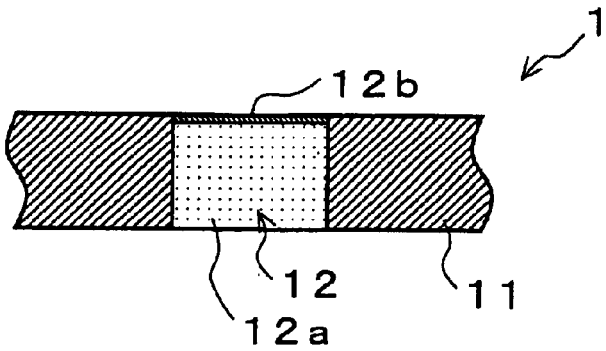
FIG. 3 is a longitudinal cross-section of a part of a polishing pad in which a window member is inserted fittingly in a substrate for a polishing pad.
Figure 4:
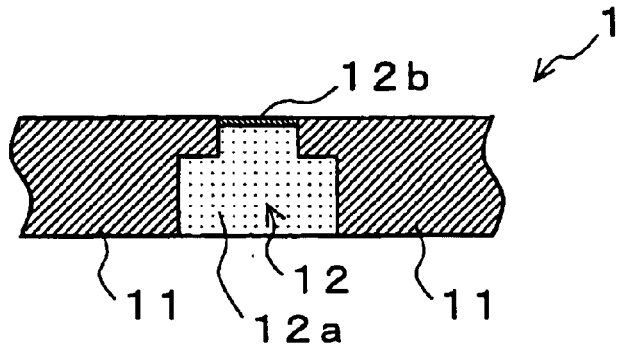
FIG. 4 is a longitudinal cross-section of a part of a polishing pad as another aspect in which a window member is inserted fittingly in a substrate for a polishing pad.
Figure 5:
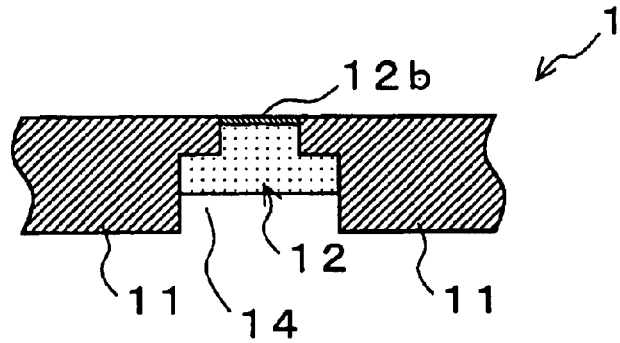
FIG. 5 is a longitudinal cross-section of a part of a polishing pad as another aspect in which a window member is inserted fittingly in a substrate for a polishing pad.
Figure 6:
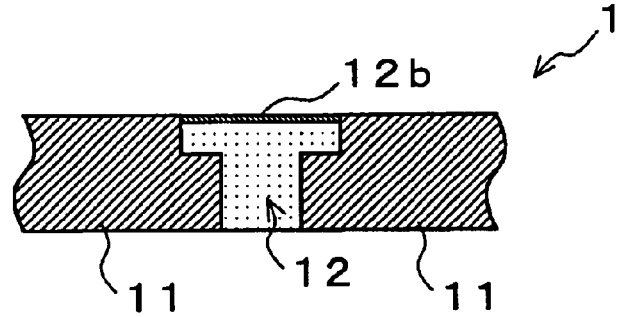
FIG. 6 is a longitudinal cross-section of a part of a polishing pad as another aspect in which a window member is inserted fittingly in a substrate for a polishing pad.
Figure 7:
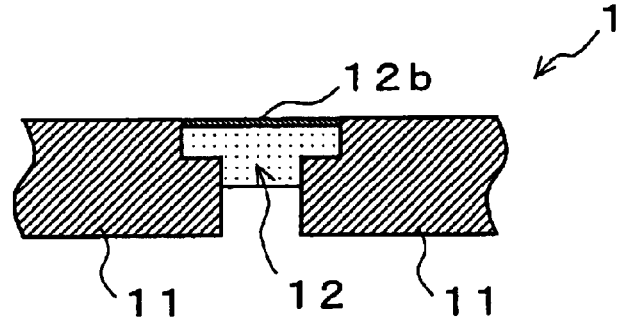
FIG. 7 is a longitudinal cross-section of a part of a polishing pad as another aspect in which a window member is inserted fittingly in a substrate for a polishing pad.
Figure 8:
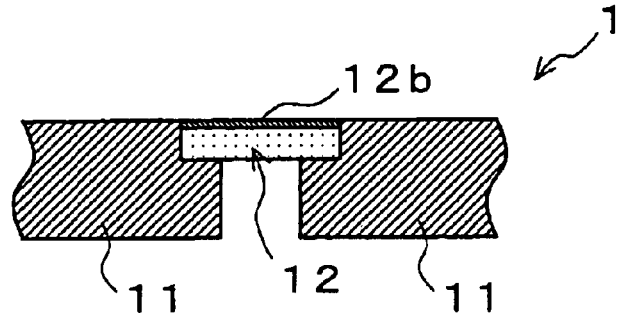
FIG. 8 is a longitudinal cross-section of a part of a polishing pad as another aspect in which a window member is inserted fittingly in a substrate for a polishing pad.
Figure 9:
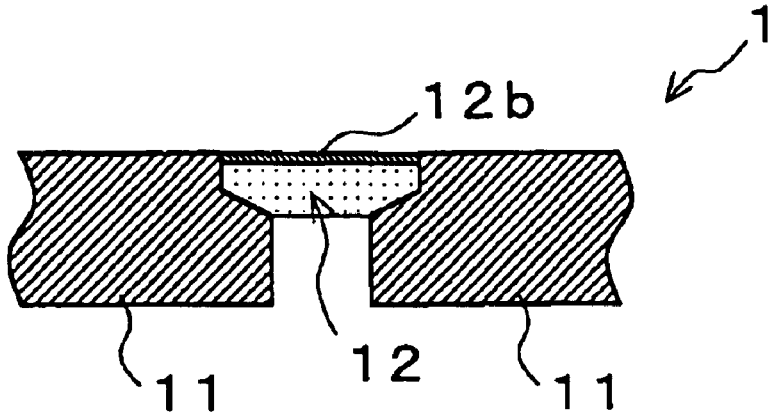
FIG. 9 is a longitudinal cross-section of a part of a polishing pad as another aspect in which a window member is inserted fittingly in a substrate for a polishing pad.
Figure 10:
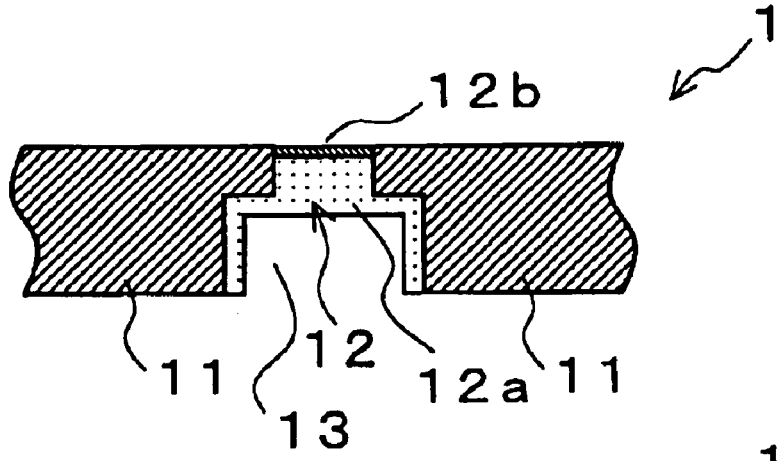
FIG. 10 is a longitudinal cross-section of a part of a polishing pad as another aspect in which a window member is inserted fittingly in a substrate for a polishing pad.
Figure 11:
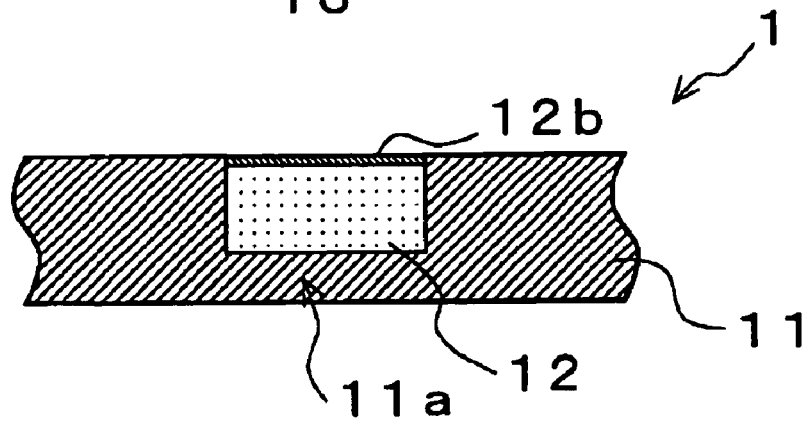
FIG. 11 is a longitudinal cross-section of a part of a polishing pad in which a window member is inserted fittingly in a concave part of a substrate for a polishing pad.

1; polishing pad, 11; substrate for polishing pad, 11*a*; thin part, 12; window member for chemical mechanical polishing, 12*a*; substrate part, 12*b*; antifouling resin layer, 13 & 14; concave part, 15; adhesive layer, 2; supporting layer, 3; pressure head, 4; semiconductor wafer, 5; slurry supplying part, 6; optical endpoint detecting part, $R_1$; endpoint detecting light, $R_2$; reflected light.

DESCRIPTION OF THE PREFERRED EMBODIMENTS

The present invention will be explained by way of Examples below but is not limited by them. In the following explanation, "part" and "%" denote part by weight and % by weight, respectively, unless otherwise indicated.

1. Formation and Evaluation of an Antifouling Resin Layer Used in a Window Member for Chemical Mechanical Polishing <Preparation of a Specific Fluorine-based Polymer>

Preparation Example 1

A stainless autoclave equipped with an electromagnetic stirrer whose inner volume is 2.0 liters was sufficiently replaced with a nitrogen gas, 500 g of ethyl acetate as a solvent. 53.2 g of perfluoro(propyl vinyl ether) (FPVE) as the component (a), 48.7 g of ethyl vinyl ether (EVE) and 26.4 g of hydroxybutyl vinyl ether (HBVE) as the component (b), 20.0 g of nonionic reactive emulsifier (manufactured by Asahidenka Co. Ltd., trade name; "Adeka REASOAP NE-30") as the component (d), 3.0 g of azo group-containing polydimethylsiloxane (manufactured by Wako Pure Chemical Industries. Co. Ltd., trade name; "VPS-1001") as the component (c) and 1.0 g of lauroyl peroxide (LPO) as a polymerization initiator were placed therein, which was cooled with a dry ice-methanol-based freezing medium to −50° C., and oxygen in the system was removed again with a nitrogen gas.

Next, 120 g of hexafluoropropylene (HFP) as the component (a) was added therein, and heating was started. The pressure when a temperature in the autoclave reached 60° C. was 6.1 kgf/cm$^2$. Thereafter, a reaction was carried out continued at 60° C. for 20 hours while stirring. After the pressure was reduced to 2.5 kgf/cm$^2$, the autoclave was cooled with water to stop the reaction. And the reaction was made to reach room temperature, the unreacted monomer was released to open the autoclave, to obtain a polymer solution. The resulting polymer solution was discharged into methanol to precipitate a polymer, which was washed with methanol, and dried in vacuum at 50° C. to obtain 221 g of a fluorine-based copolymer A1. A placed amount of a monomer for obtaining the fluorine-based copolymer A1, a yield, a polymerization conversion and a solid content are shown in Table 1.

The fluorine-based copolymer A1 was dissolved in tetrahydrofuran (THF) to prepare a 0.5% solution, which was used to obtain a number-average molecular weight reduced to polystyrene by gel permeation chromatography, and it was found to be 55,000.

Further, a glass transition temperature (Tg) by a differential scanning calorimetry (DSC) and a fluorine content by an alizarin complexon method were measured, respectively. And content of HBVE was calculated from a hydroxide value by an acetylation method using acetic anhydride. In addition, NMR analyses of $^1$H-NMR, $^{13}$C-NMR, and elementary analysis were performed and, further, a fluorine content, a hydroxide value and inorganic silica content from the remaining weight after calcination at 600° C. were measured. From these results, contents of monomer components constituting the fluorine-based copolymer A1 were obtained. The results are shown in Table 2.

Preparation Example 2 and Comparative Preparation Example 1

The fluorine-based copolymer A2 and the Comparative copolymer B1 were prepared according to the same manner as that for Preparation example 1 except that a kind and an amount to be placed of each monomer were changed as shown in Table 1. In addition, contents of monomer components constituting the copolymers and properties of copolymers are shown in Table 2.

TABLE 1

| | | Preparation example | | Comparative preparation |
|---|---|---|---|---|
| Component | Monomer (g) | 1 A1 | 2 A2 | example 1 B1 |
| (a) | HFP | 120.0 | | |
| | CTFE | | 146.6 | |
| | FPVE | 53.2 | | |
| (b) | HBVE | 26.4 | 34.5 | 213.3 |
| | EVE | 48.7 | | 56.7 |
| | Iso-BVE | | 19.7 | |
| | CHVE | | 72.3 | |

TABLE 1-continued

| | | Preparation example | | Comparative preparation |
|---|---|---|---|---|
| Component | Monomer (g) | 1 A1 | 2 A2 | example 1 B1 |
| (d) | NE-30 | 20.0 | | |
| (c) | VPS-1001 | 3.0 | 3.0 | |
| Polymerization Initiator LPO | | 1.0 | 1.0 | |
| Yield (g) | | 221 | 175 | 257 |
| Conversion (%) | | 81 | 64 | 97 |
| Solid content (%) | | 28.6 | 22.6 | 33.2 |

TABLE 2

| | | Preparation example | | Comparative preparation |
|---|---|---|---|---|
| Component | Monomer (mol %) | 1 A1 | 2 A2 | example 1 B1 |
| (a) | HFP | 41.1 | | |
| | CTFE | | 52.1 | |
| | FPVE | 10.0 | | |
| (b) | HBVE | 11.8 | 12.4 | 69.8 |
| | EVE | 33.9 | | 30.2 |
| | Iso-BVE | | 8.8 | |
| | CHVE | | 26.7 | |
| (d) | NE-30 | 0.8 | | |
| (c) | Structure unit by the component (mol %) | 2.4 | 2.6 | 0 |
| Number-average molecular weight | | 55,000 | 24,000 | 23,000 |
| Fluorine content (%) | | 49.8 | 26.0 | 0 |

Abbreviations in Tables denote the following compound.

[i] Component (a)

HFP: hexafluoropropylene

CTFE: chlorotrifluoroethylene

FPVE: perfluoro(propyl vinyl ether).

[ii] Component (b)

EVE: ethyl vinyl ether iso-BVE: isobutyl vinyl ether

CHVE: cyclohexyl vinyl ether

VAc: vinyl acetate

VPi: vinyl pivalate

VeoVa10: vinyl versatate

HBVE: hydroxybutyl vinyl ether

GVE: glycidyl vinyl ether.

[iii] Component (c)

VPS-1001: azo group-containing polydimethylsiloxane represented by the above-mentioned general formula (2), wherein y=120 to 150, z=7 to 10, having a number-average molecular weight of 70,000 to 90,000 and a molecular weight of a polysiloxane segment of about 5,000.

[iv] Component (d)

NE-30: nonionic reactive emulsifier "NE-30" represented by the above-mentioned general formula (3) wherein n=9, m=1, and s=30.

<Production of a Curable Resin Composition Solutions a1, a2 and b1>

As shown in Table 3, 100 g of the specific fluorine-based polymer A1 obtained in Preparation example 1 and 30 g of methoxylated methylmelanine (manufactured by Mitsui Cytec Co. Ltd., trade name; "Cymel 303") which is self-condensated the compound represented by the following formula (6) to obtain an average 1.7-mer as a crosslinkable compound were dissolved in 900 g of methyl isobutyl ketone (MIBK) as a solvent, and they were reacted at loot for 5 hours under stirring. After the reaction, the reaction system was cooled to room temperature to obtain a solution containing a crosslinked polymer which is a reaction product between the specific fluorine-based polymer and the crosslinkable compound.

Then, this solution was gradually poured into a large amount of cold methanol while stirring to precipitate the crosslinked polymer. Further, the resulting polymer was dissolved in MIBK, which was subjected to the precipitation using cold methanol again.

Figure 29:
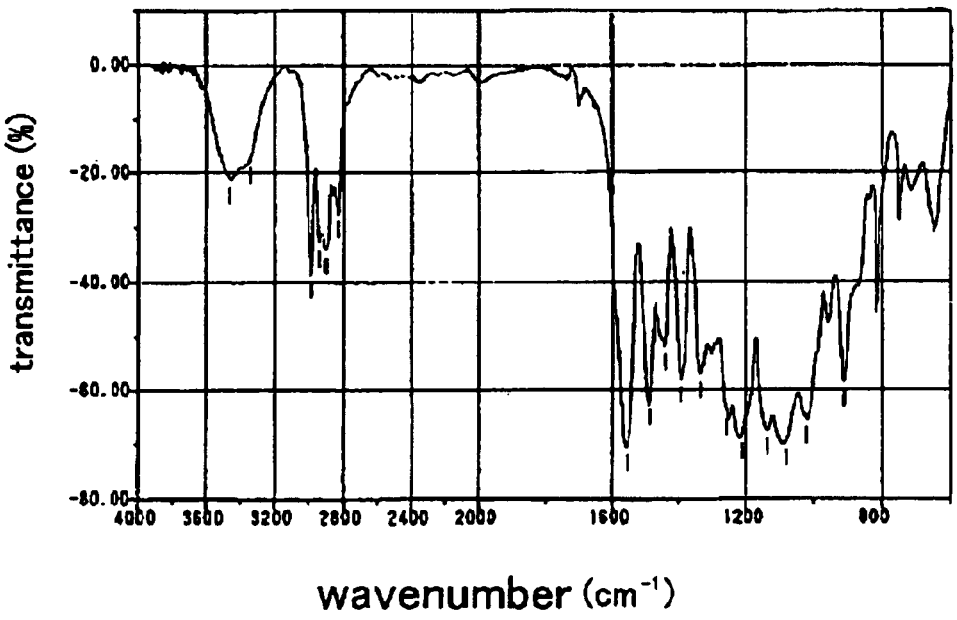
FIG. 29 is a chart illustrating an infrared absorbing spectrum of a reaction product of fluorine-based polymer A1 and a crosslinkable compound in Example.

The resulting polymer was dried by vacuum drying. A chart of the infrared absorbing spectrum of this crosslinked polymer after drying is shown in FIG. 29.

Then, 100 g of the above-mentioned crosslinked polymer and 2 g of p-toluenesulfonic acid which is a curing catalyst were added to 900 g of MIBK to dissolve them, to produce a curable resin composition solution a1. This solution had the solid content of 10% and the viscosity of 30 cps or lower.

(6)

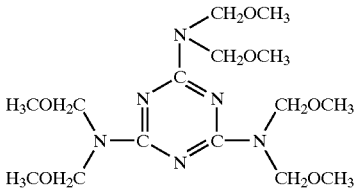

Further, a crosslinked polymer was prepared according to the same manner as that described above except that the specific fluorine-based polymer and the crosslinkable compound in the above-mentioned curable resin composition solution al were exchanged with those shown in Table 3. And a curing catalyst shown in Table 3 was added to the resulting polymer to produce curable resin composition solutions a2 and b1. In Table 3, the amount of the curing catalyst indicates an amount to be added (g) relative to 100 g of the crosslinked polymer.

TABLE 3

| | Production example | | Comparative production |
|---|---|---|---|
| | 1 | 2 | example 1 |
| Curable resin composition solution | a1 | a2 | b1 |
| Crosslinked polymer | | | |
| Copolymer | A1 | A2 | B1 |
| Solid content (g) | 100 | 100 | 100 |
| Cymel 303 (g) | 30 | 20 | 20 |
| Curing catalyst | | | |
| p-toluenesulfonic acid (g) | 2 | 2 | 2 |

<Formation and Evaluation of a Window Member Provided with a Cured Membrane Obtained from a Curable Resin Composition>

Example 1 to 4 and Comparative Example 1 to 4

Curable resin composition solutions a1, a2 and b1 produced described above were coated on each resin substrate (200 μm-thickness film) shown in Table 4 at a pulling up rate of 500 mm/min by a dip coating method, respectively. And which were heated to cure at 120° C. for 1 hour to form cured coatings.

Films on which the cured coatings had been formed were soaked in a slurry for chemical mechanical polishing containing a copper complex at 25° C. for 1 hour, respectively. And staining properties (degree of staining) by adhesion of the copper complex to the films were evaluated. Comparative Examples 2 to 4 are examples that cured coating is not formed. The slurry for chemical mechanical polishing and a stain evaluating method used are as follows.

(1) Slurry for chemical mechanical polishing: Prepared by dispersing 2% of fumed silica (Nippon Aerosil Co. Ltd., trade name; "Aerosil #901"), 1% of quinaldinic acid and 1% of hydrogen peroxide in ion-exchanged water.

(2) Stain evaluating method: In order to mimicly reproduce a copper complex produced in actual chemical mechanical polishing, 0.5% solution of copper sulfate was added to the above-mentioned slurry for chemical mechanical polishing to form a copper complex. After the film on which a cured membrane was formed was soaked in the mixed solution, the film was washed with water, and a degree of staining of the surface was determined by the following criteria visually. These results are shown in Table 4.

5: No observation of staining.

4: A part of the film was slightly stained.

3: About ½ film was stained.

2: The whole film was slightly stained.

1: The whole film was stained and no light transmitting properties were observed.

TABLE 4

| | Example | | | | Comparative Example | | | |
|---|---|---|---|---|---|---|---|---|
| | 1 | 2 | 3 | 4 | 1 | 2 | 3 | 4 |
| Resin constituting substrate | PU | PU | PMMA | PET | PU | PU | PMMA | PET |
| Curable resin composition solution | a1 | a2 | a1 | a1 | b1 | — | — | — |
| Degree of staining | 5 | 4 | 5 | 5 | 2 | 1 | 1 | 2 |
| Anti-scratching | ○ | ○ | ○ | ○ | × | — | — | — |
| Transmittance (%) | 82 | 78 | 91 | 89 | 10 | <5 | <5 | <5 |

Further, according to the following method, an anti-scratching test (Examples 1 to 4 and Comparative Example 1) was carried out. That is, each curable resin composition solution shown in the Table 4 was diluted with butanol to prepare a varnish having the solid content of 4%. This varnish was coated on a transparent polyurethane film having a thickness of 0.2 mm at a pulling up rate of 500 mm/min. by a dip coating method, and the resulting coating was heated at 120° C. for 1 hour to form a cured membrane. The thickness of the cured membrane measured by an ellipsometer was 1,140 Å. A prescribed resin sheet on which a cured membrane was formed (referred to as "sample") was made.

Regarding the above-mentioned respective samples, an anti-scratching test was performed in order to evaluate the adherability of the cured membrane to the polyurethane film and the strength of the cured membrane. That is, a surface of the cured membrane was abraded repeatedly 25 times under a load of 1 kg/cm$^2$ using a wiping paper (manufactured by Jujo Kimbery Co. Ltd., trade name; "Kimwipe"), and the presence or the absence of a flaw on the surface of the cured membrane was checked visually. And, no observation of a peeling and a flaw was evaluated as "○", and a peeling on a part of a cured membrane, or a linear flaw on the surface of the cured membrane was evaluated as "X ". In addition, transmittances of the samples after the evaluation of staining were measured in the range of 400 to 800 nm with ultraviolet spectroscopy (manufactured by Hitachi Co. Ltd., type; "U-2010") and average data were calculated.

These results are also shown in Table 4.

Based on the results in Table 4, it can be seen that resin sheets using cured resin compositions according to Examples 1 to 4 have excellent antifouling properties. To the contrary, in the case of Comparative Example 1 in which a cured membrane was formed using a polymer containing no fluorine, and Comparative Examples 2 to 4 in which cured membranes were not formed, it can be seen that the anti-fouling property improving effects are hardly perceived. And it can be seen that the anti-scratching is also excellent in Examples 1 to 4 as compared with Comparative Example 1.

2. Production and Evaluation of a Belt-type Polishing Pad

[1] Production of a Polishing Pad

Figure 12:
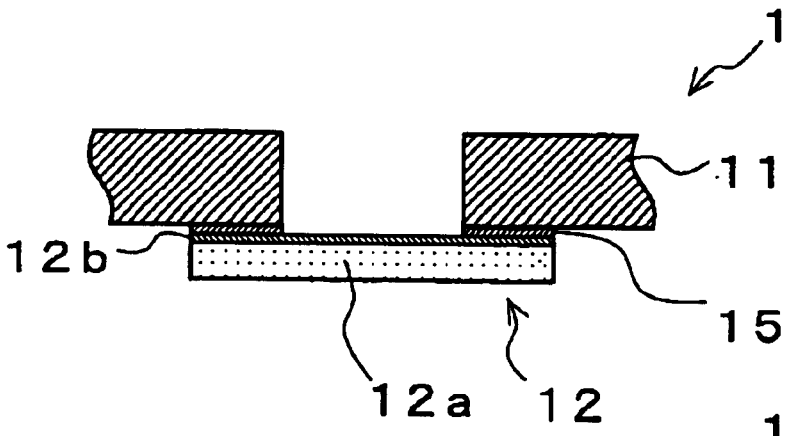
FIG. 12 is a longitudinal cross-section of a part of a polishing pad in which a window member is adhered to a substrate for a polishing pad so as to cover an opening part of a through hole.
Figure 13:
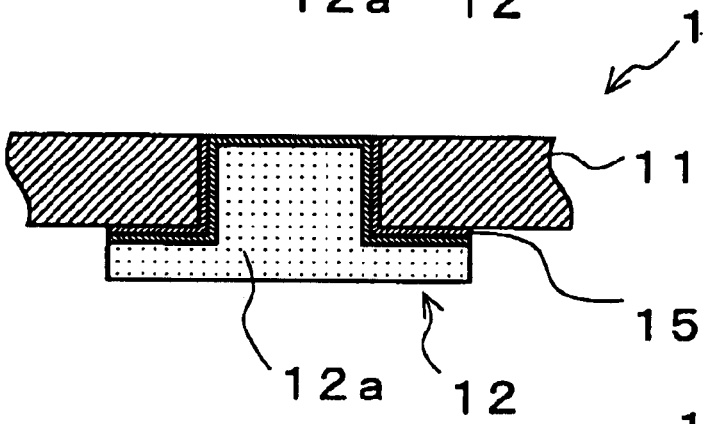
FIG. 13 is a longitudinal cross-section of a part of a polishing pad in which a window member is inserted fittingly in a through hole, and is adhered to a substrate for a polishing pad so as to cover an opening part.
Figure 14:
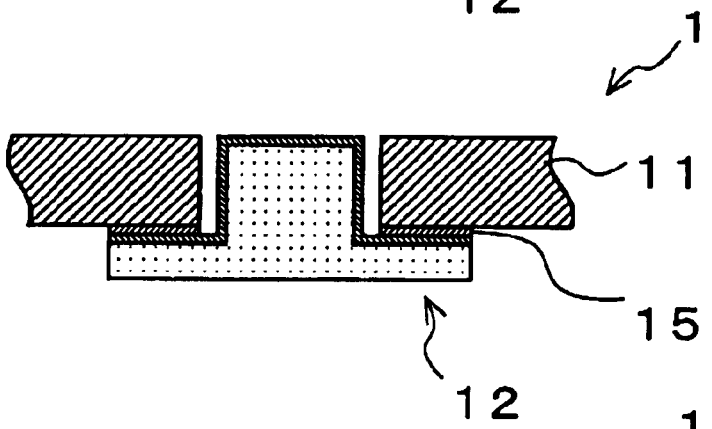
FIG. 14 is a longitudinal cross-section of a part of a polishing pad in which a window member is inserted such that there is a gap left in a through hole.
Figure 15:
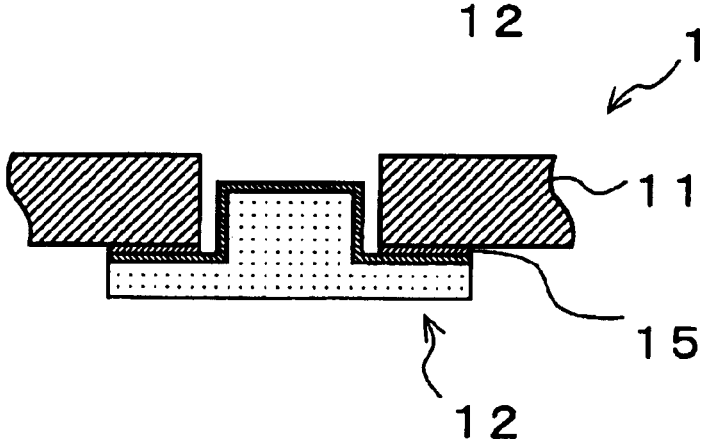
FIG. 15 is a longitudinal cross-section of a part of a polishing pad in which an upper level of an inserted window member is lower than an upper level of a substrate for a polishing pad.
Figure 16:
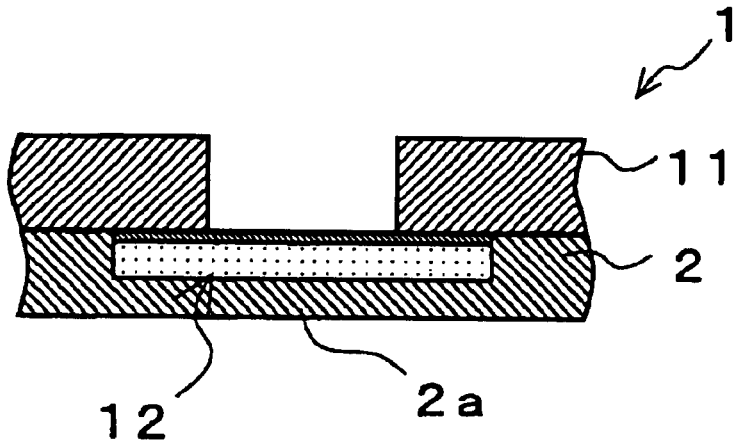
FIG. 16 is a longitudinal cross-section of a part of a polishing pad in which a sheet-like (or plate-like) window member is adhered to a substrate for a polishing pad so as to cover an opening part of a through hole, and a supporting layer is laminated on a back.
Figure 17:
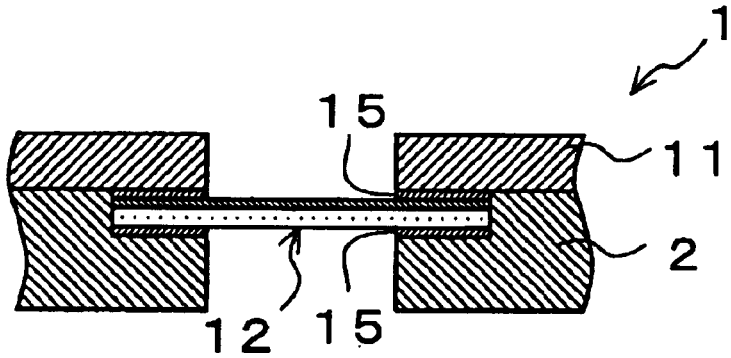
FIG. 17 is a longitudinal cross-section of a polishing pad in which a sheet-like (or plate-like) window member is adhered to a substrate for a polishing pad so as to cover an opening part of a through hole and, at the same time, both ends of a window member are disposed between a substrate for a polishing pad and a supporting layer to be laminated on a back thereof.
Figure 18:
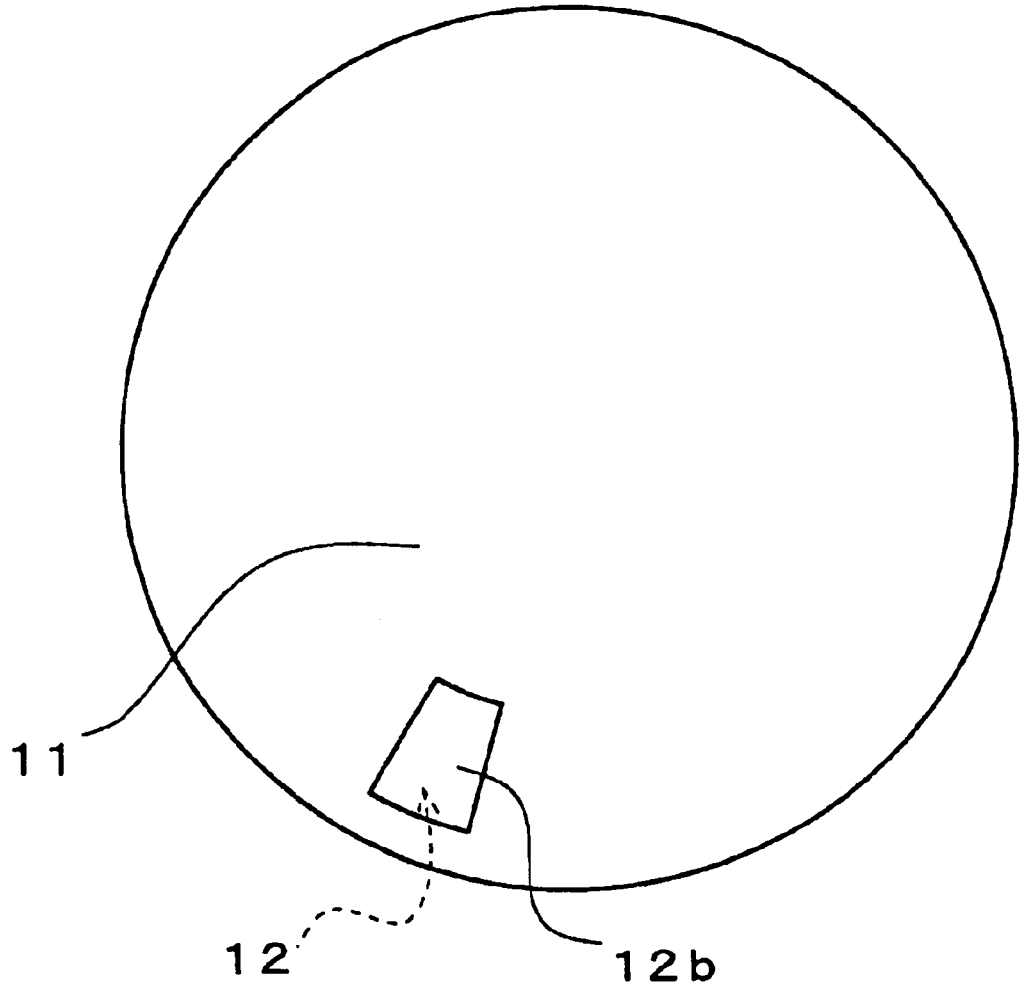
FIG. 18 is a plane view of one example of a disc-like polishing pad.
Figure 19:
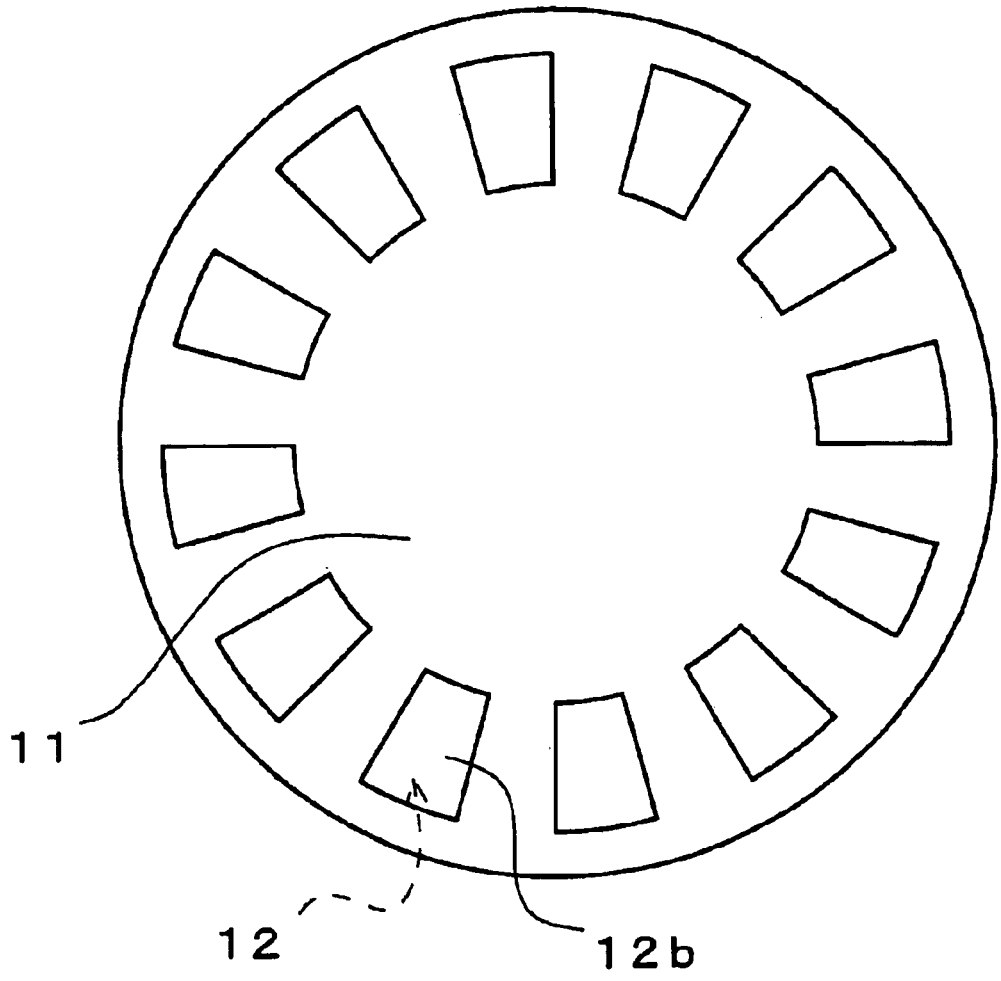
FIG. 19 is a plane view of another example of a disc-like polishing pad.
Figure 20:
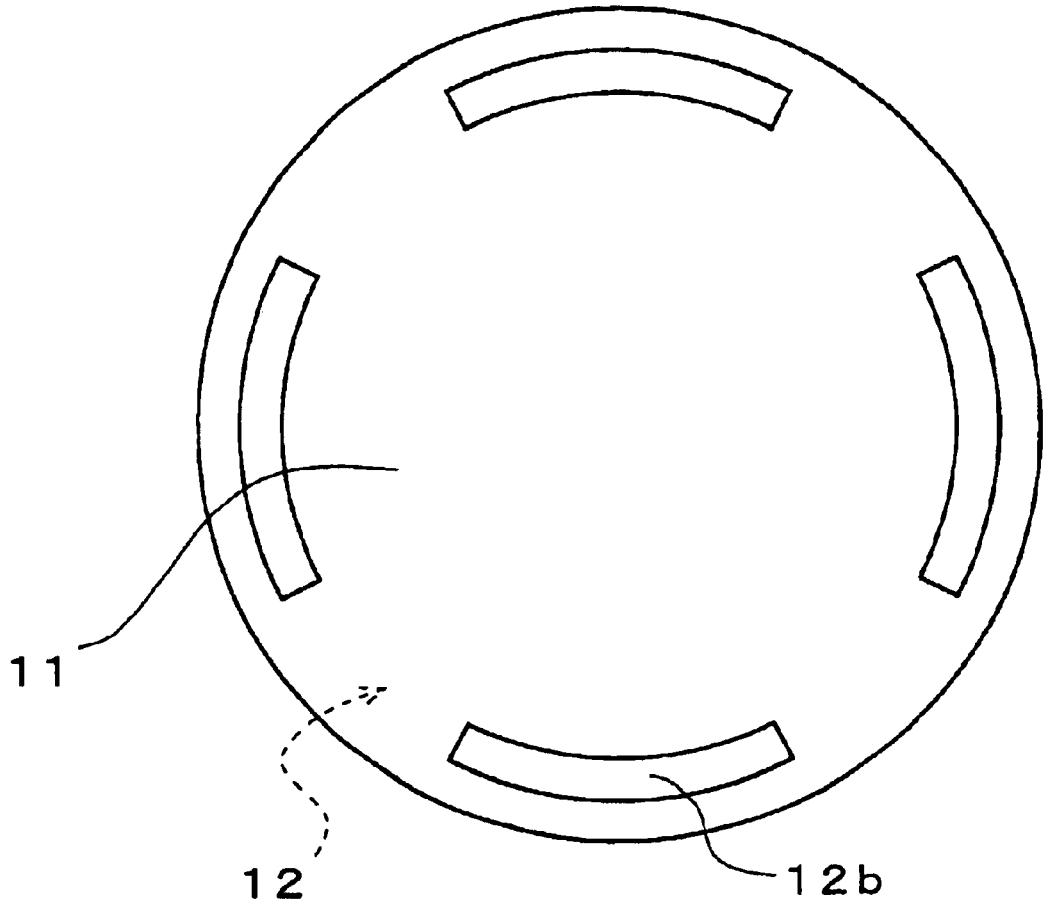
FIG. 20 is a plane view of another example of a disc-like polishing pad.
Figure 21:
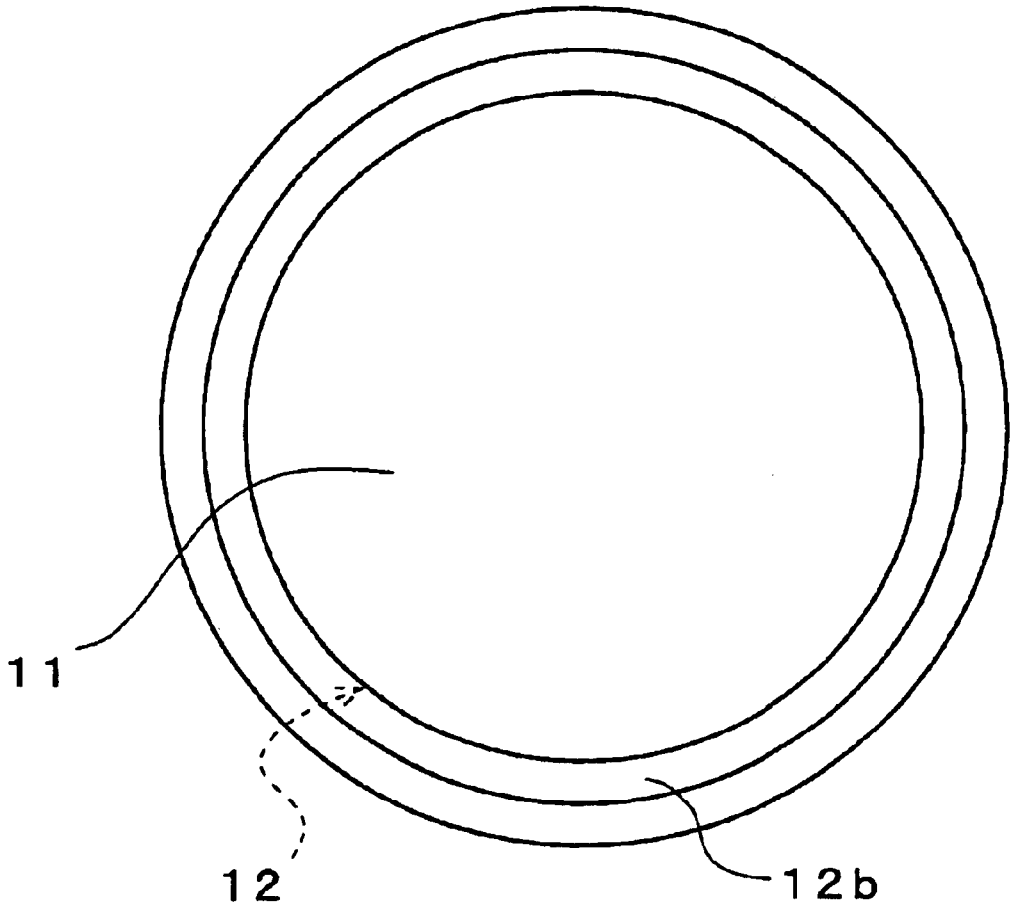
FIG. 21 is a plane view of another example of a disc-like polishing pad.
Figure 22:
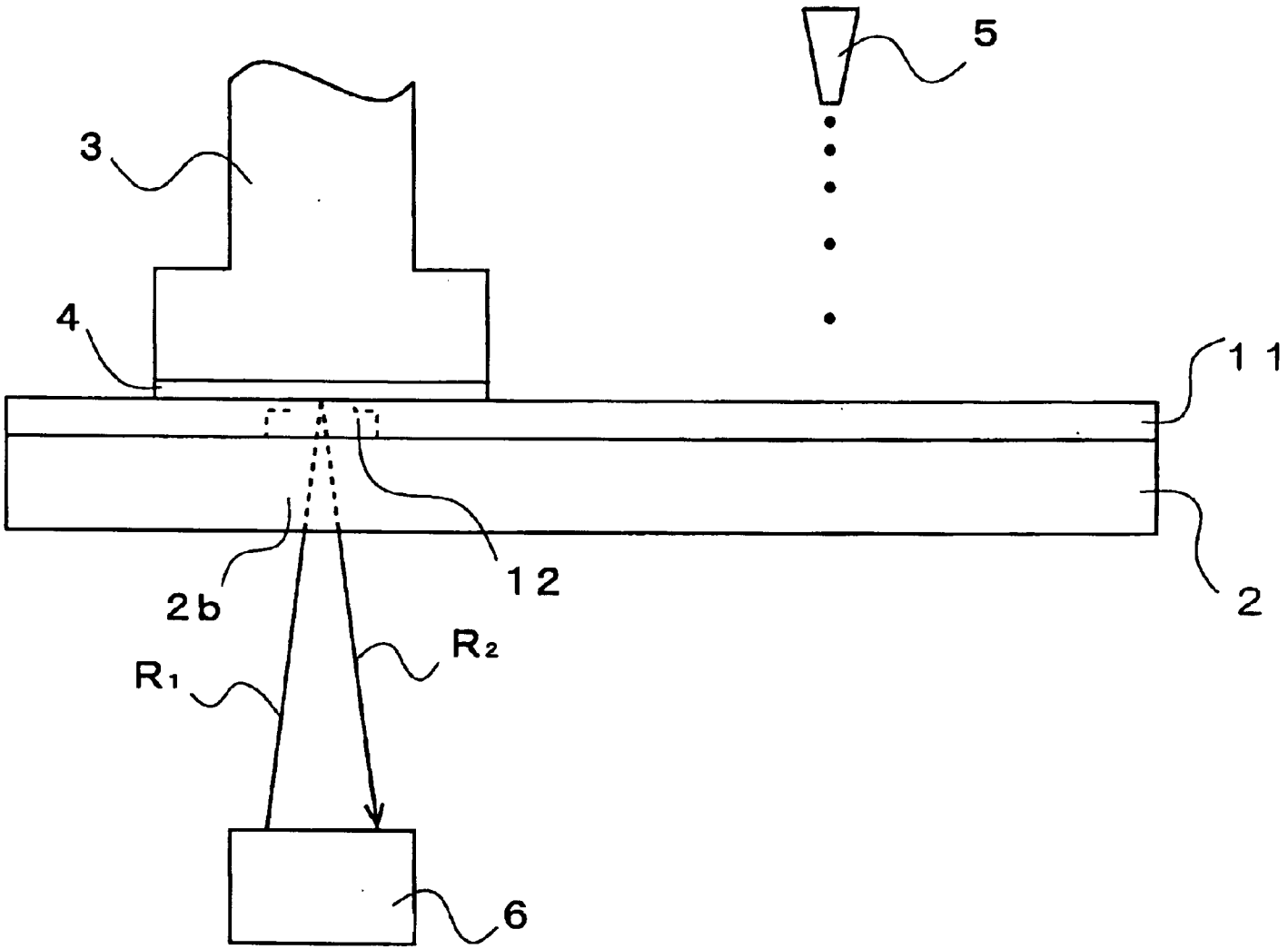
FIG. 22 is a schematic view illustrating a polishing apparatus using a polishing pad.
Figure 23:
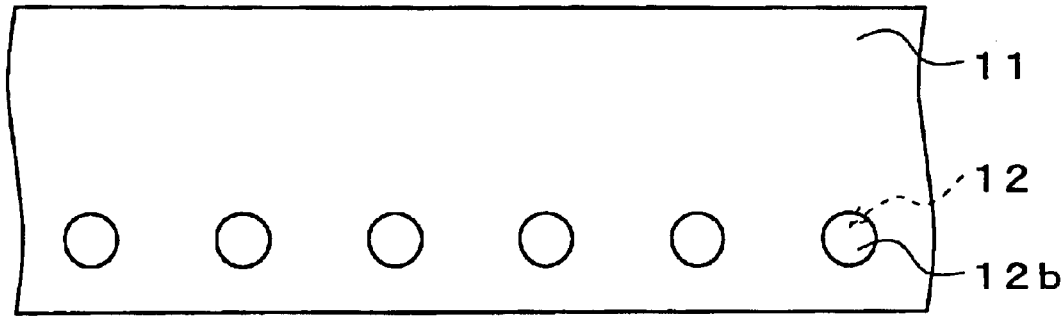
FIG. 23 is a plane View of a part of a belt-like polishing pad provided with a circular window member.
Figure 24:
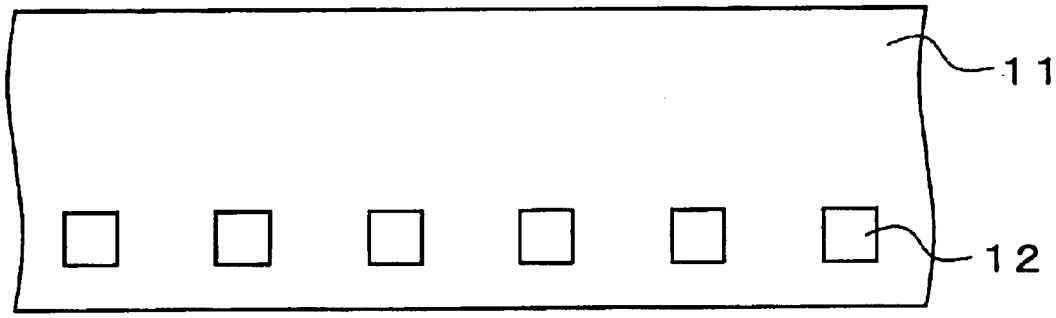
FIG. 24 is a plane view of a part of another example of a belt-like polishing pad provided with a square window member.
Figure 25:
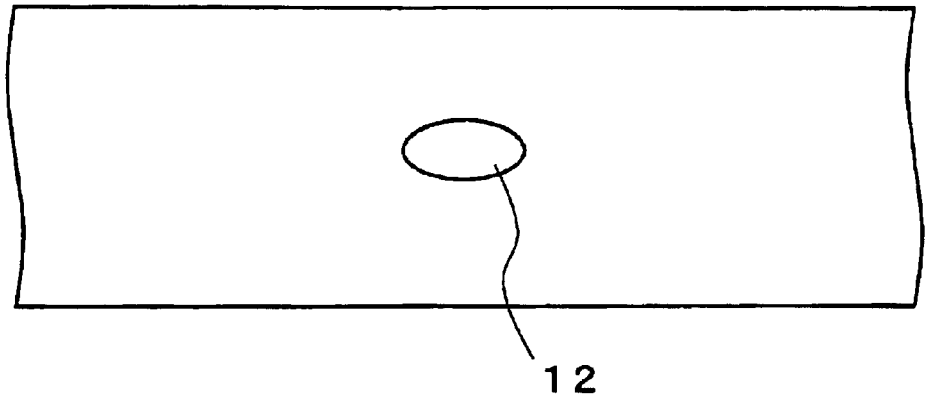
FIG. 25 is a plane view of a part of another example of a belt-like polishing pad provided with an elliptic window member.
Figure 26:
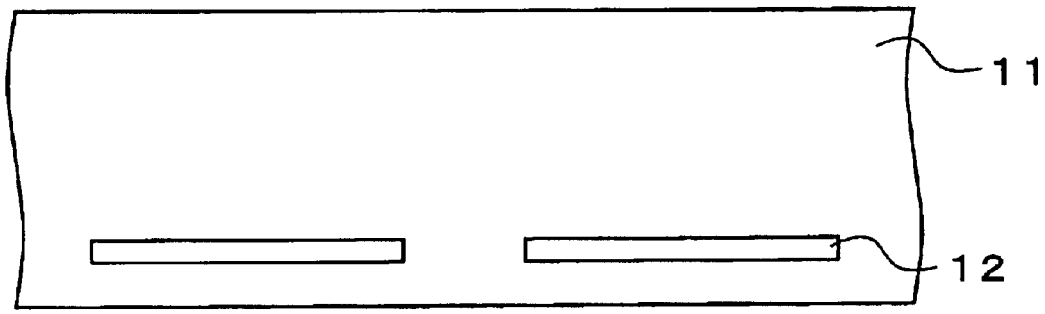
FIG. 26 is a plane view of a part of another example of a belt-like polishing pad provided with a long square window member.
Figure 27:
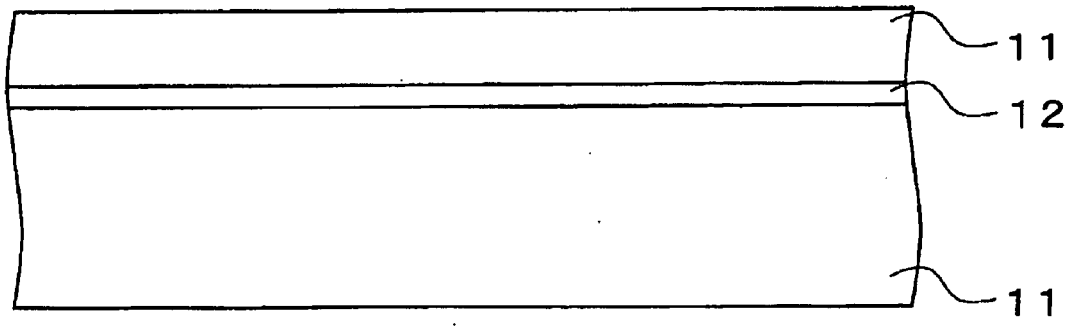
FIG. 27 is a plane view of a part of another example of a belt-like polishing pad.

First, a polyurethane resin part which is to constitute a substrate part 12*a* for a window member is prepared. This part has a sheet shape whose length is 65 mm, width 50 mm and height 0.3 mm (see FIG. 12). On this part was formed a cured membrane (antifouling resin layer, thickness; about 1,150 Å) 12*b* using the curable resin composition solution al obtained in the above Production example 1 by the dip coating method as described above, to produce a window member 12 (see FIG. 12).

On the other hand, a belt comprised of polyurethane foam (total length; about 2,000 mm, transverse width; about 350 mm, thickness; about 3 mm) was prepared, and two through holes (long diameter; about 3.2 mm, short diameter; about 2.5 mm) were provided at an interval of about 1,000 mm. And, the above-mentioned window member 12 was fixed by adhering to a bottom of a substrate 11 for a polishing pad with adhesives so as to cover opening parts of these through holes. Thereby, a polishing pad 1 used in this test was produced (see FIG. 12).

In addition, 100 parts of 1,2-polybutadiene (manufactured by JSR Corp., trade name; "JSR RB840") and 100 parts of β-cyclodextrin (manufactured by Bio Research Corporation of Yokohama, trade name; "Dexipearl β-100") as a water-soluble material were kneaded at 120° C. with a kneader and, thereafter, 0.3 part of an organic peroxide (manufactured by NOF Corp., trade name; "Perhexine 25B") was added thereto, the mixture was kneaded, and crosslinking-reacted at 190° C. for 10 minutes to prepare a molded belt (total length; about 2,000 mm, transverse width; about 350 mm, thickness; about 3 mm). Similarly, two through holes (long diameter; about 3.2 mm, short diameter; about 2.5 mm) were provided at an interval of about 1,000 mm, and the above-mentioned window member 12 was fixed by adhering to a bottom of a substrate for a polishing pad with an adhesive so as to cover opening parts of these through holes. Thereby, a polishing pad 1' used in this test was prepared.

[2] Evaluation (Example)

Figure 28:
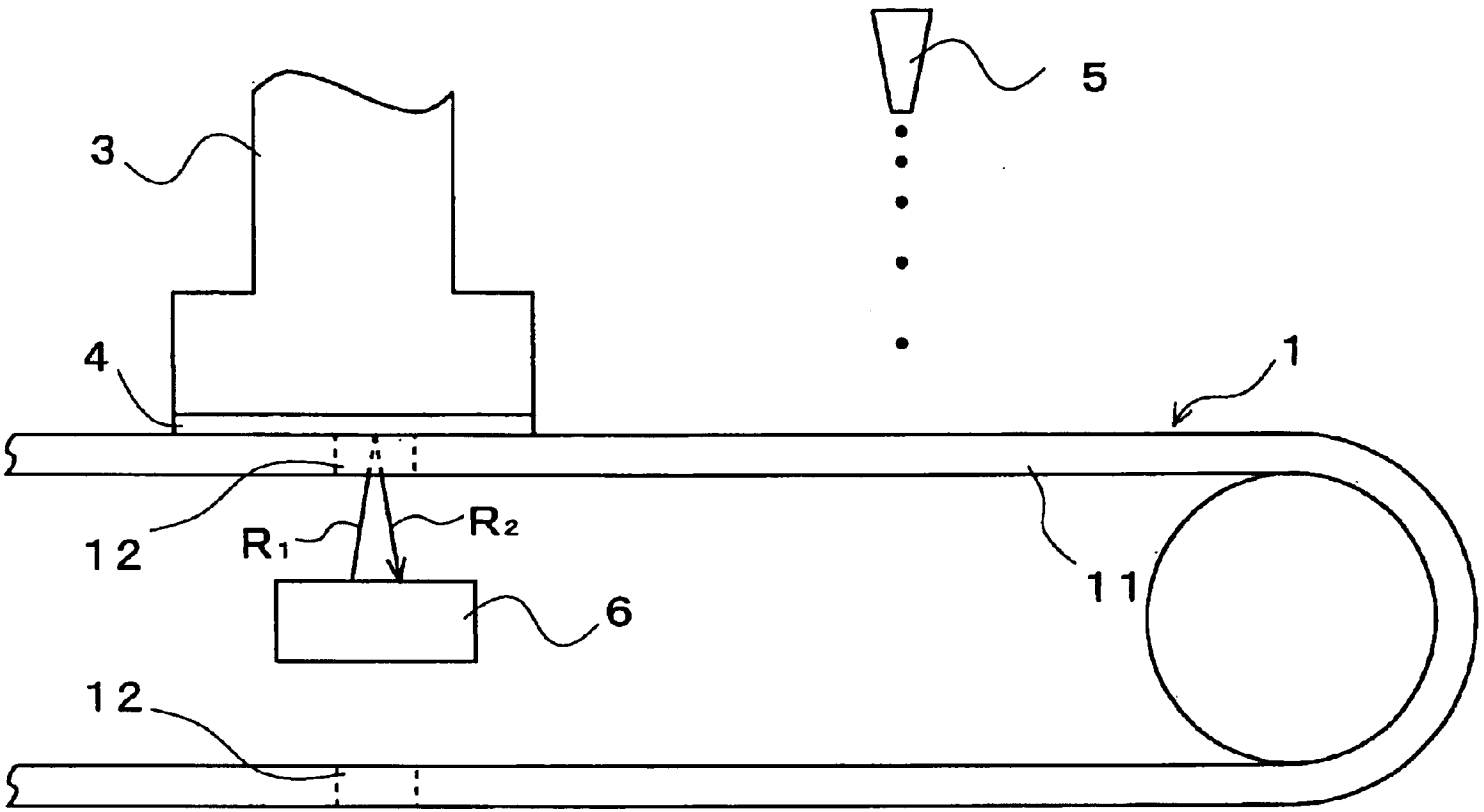
FIG. 28 is a schematic view illustrating a polishing apparatus using a belt-like polishing pad.

The polishing performances of the above-mentioned polishing pads 1 and 1' were evaluated using a belt-type polishing apparatus schematically shown in FIG. 28. That is, the belt-like polishing pad 1 or 1' is suspended on a pair of rolls and is rotated in a certain direction by rotation of a roll. And, a pressure head 3 which is rotatable and movable in a longitudinal or transverse direction is disposed on the polishing pad (belt) 1 or 1'. Further, a slurry supplying part 5 which can add a slurry dropwise on a surface plate at a constant amount per unit time is set on the polishing pad 1 or 1'. In addition, an optical endpoint detecting part 6 is equipped under the rotating belt-like polishing pad 1 or 1'.

And, an 8 inch semiconductor wafer (on which a copper membrane as a material to be polished is formed) 4 is fixed on a lower end of the pressure head 3 and, at the same time, the belt-like polishing pad 1 or 1' is rotated. And, the pressure head 3 is rotated (rotation number; about 60 to 70 rpm) while a polishing slurry (the above-mentioned "Aerosil #90") is added dropwise on a surface plate or the like at a prescribed amount (for example, 100 ml/min.) from a slurry supplying part, and polishing was performed by sliding the semiconductor wafer 4 and the polishing pad 1 or 1' while pushing the semiconductor wafer 4 against the polishing pad 1 or 1' at a prescribed pressure. And, a polishing endpoint is determined at where the reflectance was changed by optical measurement, at the same time a wafer was exchanged. And the relationship between the number of these exchanges and possibility of optical endpoint detection of the window member was evaluated.

In the above Example, 60 wafers were continuously polished using polishing pads 1 and 1' having a different material constituting a substrate for a polishing pad. It was observed that endpoint detection was correctly achieved and transmittances of window members were hardly affected. On the other hand, in the case in which the same procedures as above were adopted except for the absence of a cured membrane, the similar evaluation was performed as a comparative, and the surface turned into green at 20th wafer and endpoint detection became difficult.

Therefore, since a window member of a belt-like polishing pad is excellent in durability under the conditions of chemical mechanical polishing, endpoint detection with the light can be stably performed.

Further, since a window member and a substrate for a polishing pad are comprised of polyurethane or polybutadiene, this polishing pad is excellent in flexibility. Therefore, it can be seen that this window member and a polishing pad using this window member are suitable for a belt-type polishing method. In particular, since this window member is transparent and is not colored by polishing, it can be seen that a polishing pad using this window member is extremely useful in an endpoint detecting method in which the light for endpoint detection passed through the window member is reflected on a side to be polished of a semiconductor wafer, the reflected light $R_2$ transmits again through the window member, and this transmitted light is detected with an optical endpoint detector.

What is claimed is:

1. A window member for chemical mechanical polishing comprising a substrate part which is at least partially transparent, and an antifouling resin layer formed on at least one side of said substrate part, wherein said antifouling resin layer is comprised of a fluorine-based polymer having a polysiloxane segment in a main chain.

2. The window member for chemical mechanical polishing according to claim 1, wherein said substrate part is comprised of at least one resin selected from the group consisting of a polyester resin, a triacetylcellulose resin, a polycarbonate resin, an allylcarbonate resin, a polyethersulfone resin, a polyacrylate resin, a norbornene resin, an acrylstyrene resin, a polyurethane resin arid a polyolefin resin.

3. The window member for chemical mechanical polishing according to claim 1, wherein said antifouling resin layer is produced by curing a crosslinkable compound and a curable resin composition comprising an olefin-based polymer having a polysiloxane segment in a main chain, the olefin-based polymer has a content of fluorine of 20 wt % or more, and the olefin-based polymer has a number average molecular weight of 5,000 or more reduced to polystyrene.

4. The window member for chemical mechanical polishing according to claim 3, wherein said olefin-based polymer has at least one of a hydroxyl group and an epoxy group.

5. The window member for chemical mechanical polishing according to claim 4, wherein said substrate part is comprised of at least one resin selected from the group consisting of a polyester resin, a triacetylcellulose resin, a polycarbonate resin, an allylcarbonate resin, a polyethersulfone resin, a polyacrylate resin, a norbornene resin, an acrylstyrene resin, a polyurethane resin and a polyolefin resin.

6. The window member for chemical mechanical polishing according to claim 3, wherein said crosslinkable compound is an amino compound or a hydroxyl groupcontaining compound.

7. The window member for chemical mechanical polishing according to claim 6, wherein said amino compound is a melamine-based compound, a urea-based compound, a benzoguanamine-based compound or a glycoluryl-based compound, and wherein said hydroxyl groupcontaining compound is pentaerythritol, polyphenol or glycol.

8. The window member for chemical mechanical polishing according to claim 1, wherein said fluorine-based polymer is obtained by reacting a fluorine-containing olefin compound, another monomer compound copolymerizable with said fluorine-containing olefin compound, and an azo group-containing polysiloxane compound.

9. The window member for chemical mechanical polishing according to claim 1, wherein said polysiloxane segment is represented by the following general formula (1)

(1)

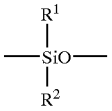

where $R^1$ and $R^2$ are the same or different, and denote a hydrogen atom, an alkyl group, a halogenated alkyl group or an aryl group.

10. A polishing pad having a window member for chemical mechanical polishing comprising a substrate part which is at least partially transparent, and an antifouling resin layer formed on at least one side of said substrate part, wherein said antifouling resin layer is comprised of a fluorine-based polymer having a polysiloxane segment in a main chain.

11. The polishing pad according to claim 10, wherein said substrate part is comprised of at least one resin selected from the group consisting of a polyester resin, a triacetylcellulose resin, a polycarbonate resin, an allylcarbonate resin, a polyethersulfone resin, a polyacrylate resin, a norbornene resin, an acrylstyrene resin, a polyurethane resin and a polyolefin resin.

12. The polishing pad according to claim 11, wherein said window member for chemical mechanical polishing is fixed to a through hole of a substrate for a polishing pad provided with said through hole penetrating from surface to back.

13. The polishing pad according to claim 12, further comprising a supporting layer laminated on a back of said substrate for a polishing pad.

14. The polishing pad according to claim 11, wherein said window member for chemical mechanical polishing is inserted between two or more divided substrates for a polishing pad.

15. The polishing pad according to claim 14, further comprising a supporting layer laminated on a back of said substrate for a polishing pad.

16. The polishing pad according to claim 11, wherein said window member for chemical mechanical polishing is adhered to a substrate for a polishing pad so as to cover an opening part of a through hole penetrating the substrate for a polishing pad from surface to back.

17. The polishing pad according to claim 10, wherein said anti fouling resin layer is produced by curing a crosslinkable compound and a curable resin composition comprising an olefin-based polymer having a polysiloxane segment in a main chain, the olefin-based polymer has a content of fluorine of 20 wt % or more, and the olefin-based polymer has a number average molecular weight of 5,000 or more reduced to polystyrene.

18. The polishing pad according to claim 17, wherein said olefin-based polymer has at least one of a hydroxyl group and an epoxy group.

19. The polishing pad according to claim 18, wherein said substrate part is comprised of at least one resin selected from the group consisting of a polyester resin, a triacetylcellulose resin, a polycarbonate resin, an allylcarbonate resin, a polyethersulfone resin, a polyacrylate resin, a norbornene resin, an acrylstyrene resin, a polyurethane resin and a polyolefin resin.

20. The polishing pad according to claim 19, wherein said window member for chemical mechanical polishing is fixed to a through hole of a substrate for a polishing pad provided with said through hole penetrating from surface to back.

21. The polishing pad according to claim 20, further comprising a supporting layer laminated on a back of said substrate for a polishing pad.

22. The polishing pad according to claim 19, wherein said window member for chemical mechanical polishing is inserted between two or more divided substrates for a polishing pad.

23. The polishing pad according to claim 22, further comprising a supporting layer laminated on a back of said substrate for a polishing pad.

24. The polishing pad according to claim 19, wherein said window member for chemical mechanical polishing is adhered to a substrate for a polishing pad so as to cover an opening part of a through hole penetrating the substrate for a polishing pad from surface to back.

* * * * *